US006674422B2

(12) United States Patent
Ozawa

(10) Patent No.: US 6,674,422 B2
(45) Date of Patent: Jan. 6, 2004

(54) METHOD FOR DRIVING ELECTRO-OPTICAL PANEL, DATA LINE DRIVING CIRCUIT THEREOF, ELECTRO-OPTICAL APPARATUS, AND ELECTRONIC EQUIPMENT

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

(21) Appl. No.: 09/828,832

(22) Filed: Apr. 10, 2001

(65) Prior Publication Data

US 2002/0024510 A1 Feb. 28, 2002

(30) Foreign Application Priority Data

Apr. 17, 2000 (JP) ..... 2000-115208

(51) Int. Cl.[7] ..... G09G 3/36
(52) U.S. Cl. ..... 345/98; 345/100
(58) Field of Search ..... 345/87–100, 204; 349/49, 54; 348/674, 675, 790–792

(56) References Cited

U.S. PATENT DOCUMENTS 5,469,281 A * 11/1995 Katakura et al.
6,160,532 A * 12/2000 Kaburagi et al.
6,542,143 B1 * 4/2003 Ozawa

FOREIGN PATENT DOCUMENTS

| | | |
|---|---|---|
| JP | 07-72832 A | 3/1995 |
| JP | 08-22266 A | 1/1996 |
| JP | 10-69249 A | 3/1998 |
| JP | 10-74060 A | 3/1998 |

* cited by examiner

*Primary Examiner*—Regina Liang
(74) *Attorney, Agent, or Firm*—Oliff & Berridge, PLC

(57) ABSTRACT

A data line driving circuit drives data lines of an electro-optical panel, which occupies a small area and can drive the data lines with low power consumption. When the digit of the most significant bit is "0", all of the γ-correction switches are in an on-state. Thus, the γ-correction is not performed. Conversely, when the digit of the most significant bit is "0", the γ-correction switches are put into an on-state according to the data value represented by low order bits. Thus, the γ-correction is performed. That is, whether or not the γ-correction is performed can be determined according to which of the white side and the black side the gray scale level to be displayed is on. Furthermore, irrespective of whether or not the γ-correction is performed, DAC capacitances are used for both the cases that the γ-correction is performed, and that γ-correction is not performed. Thus, the size of the circuit can be reduced.

9 Claims, 16 Drawing Sheets

[FIG. 1]
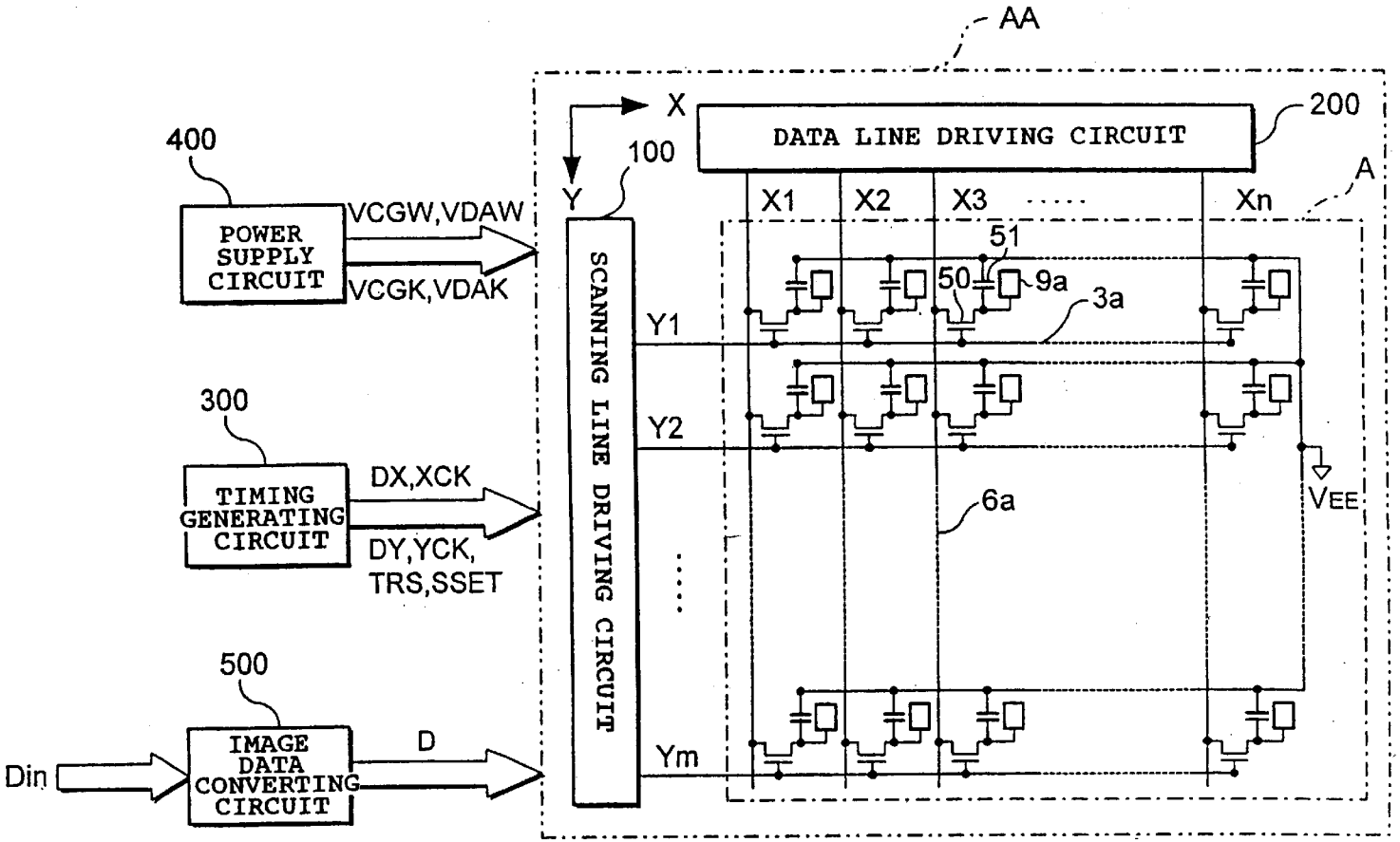

[FIG. 2]
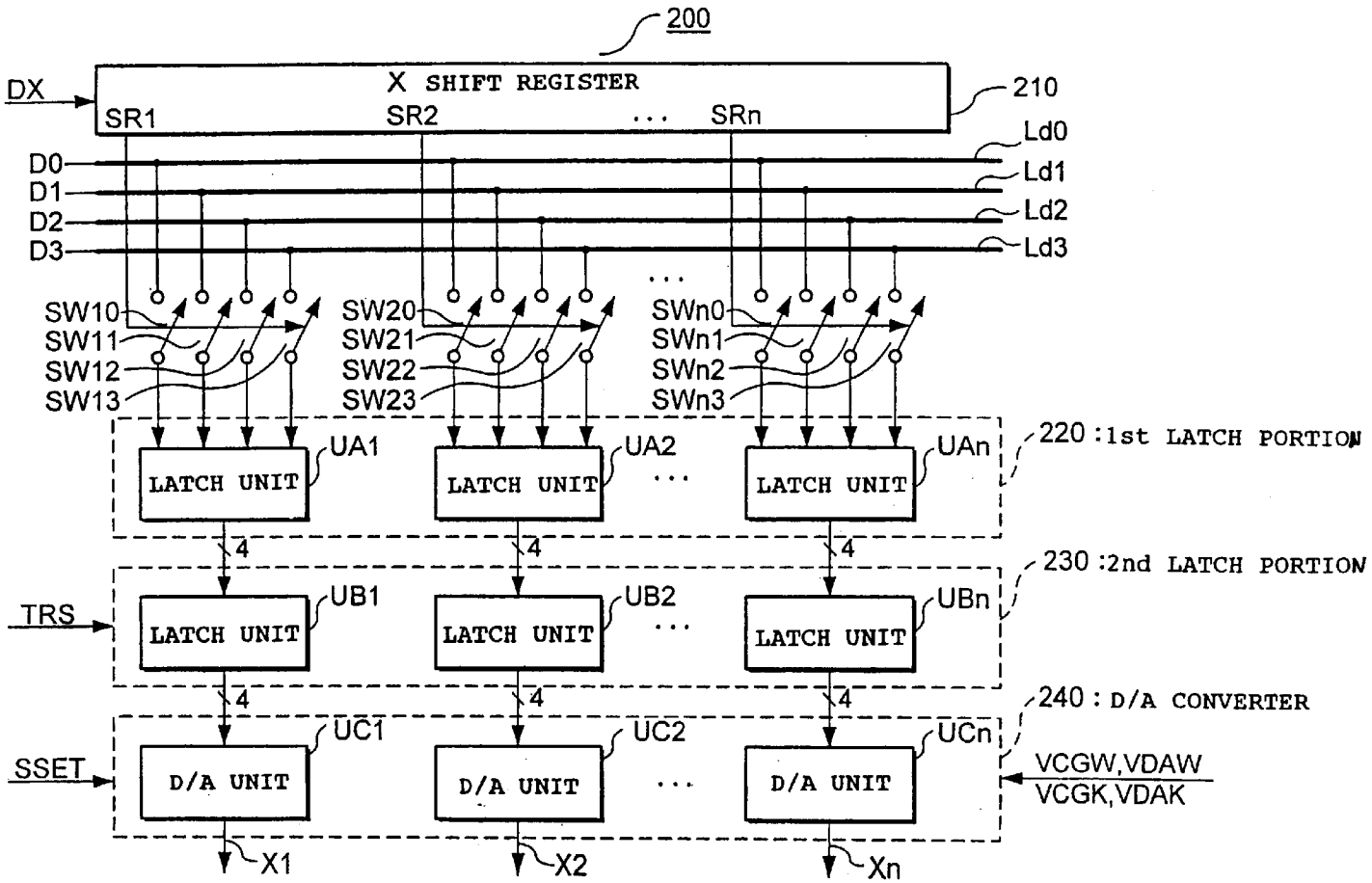

[FIG. 3]
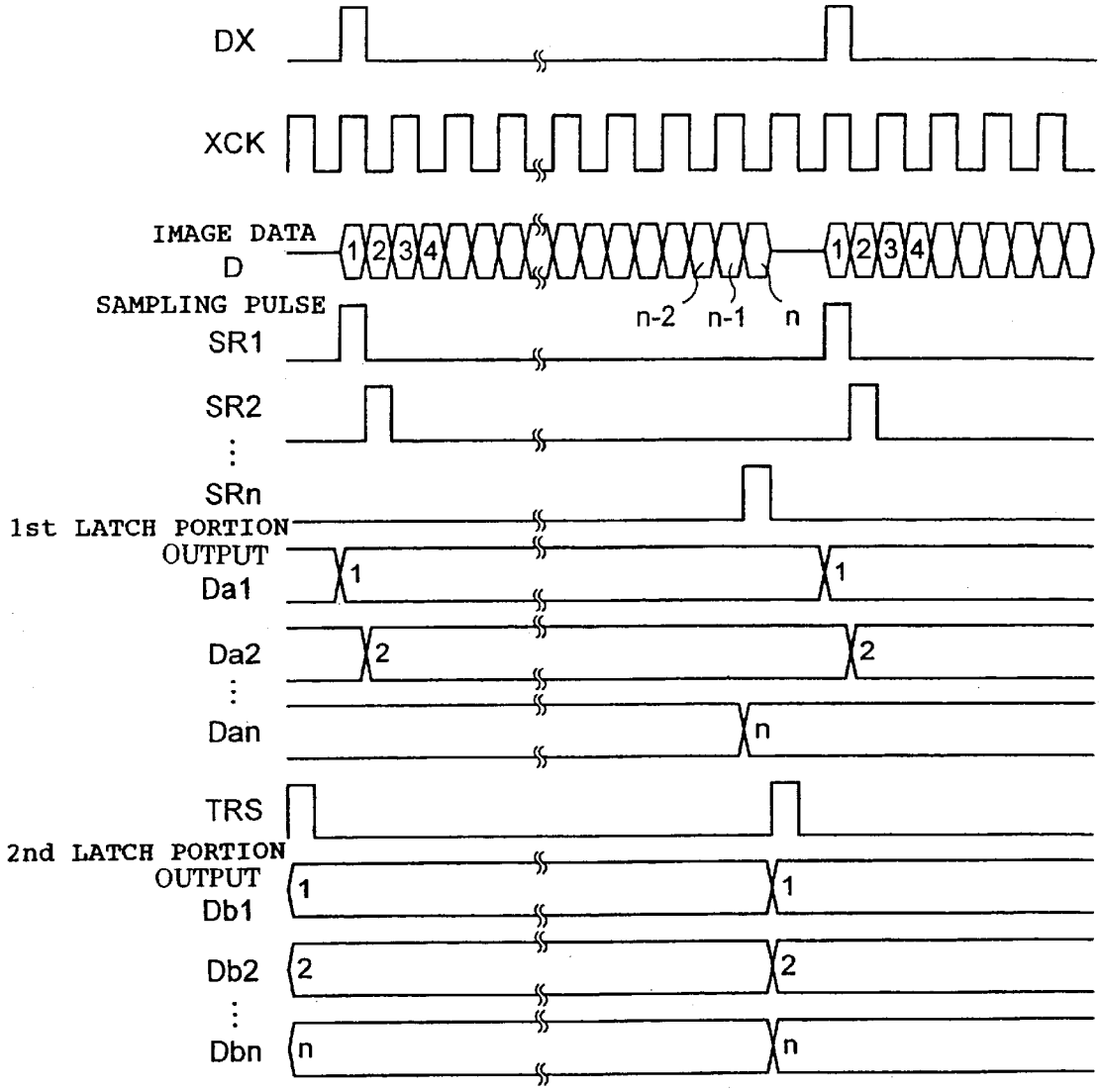

[FIG. 4]
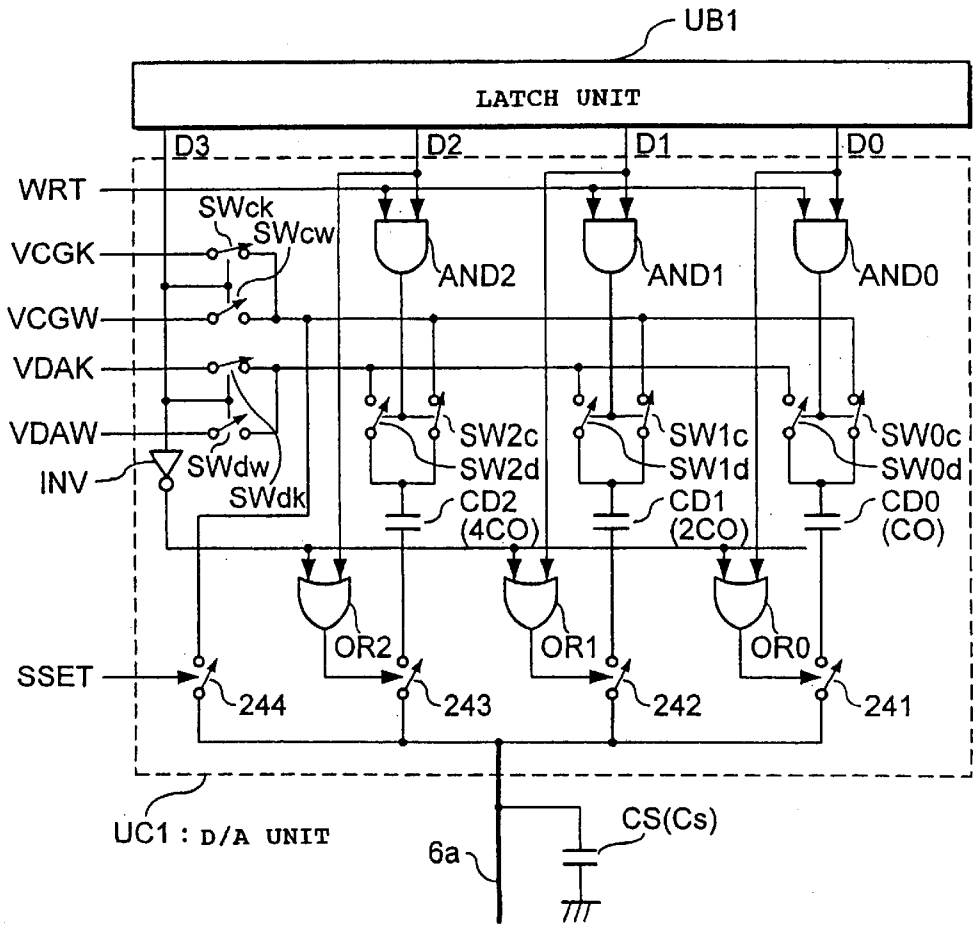

[FIG. 5]
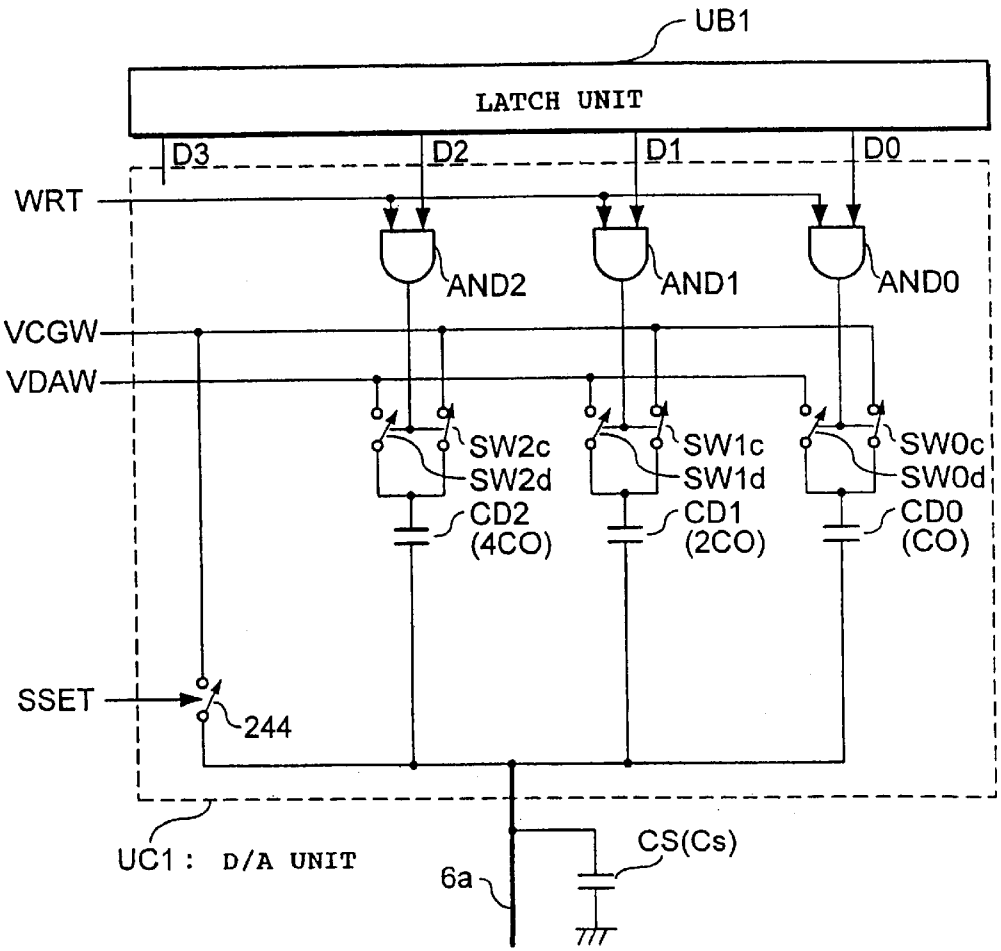

[FIG. 6]
(A)
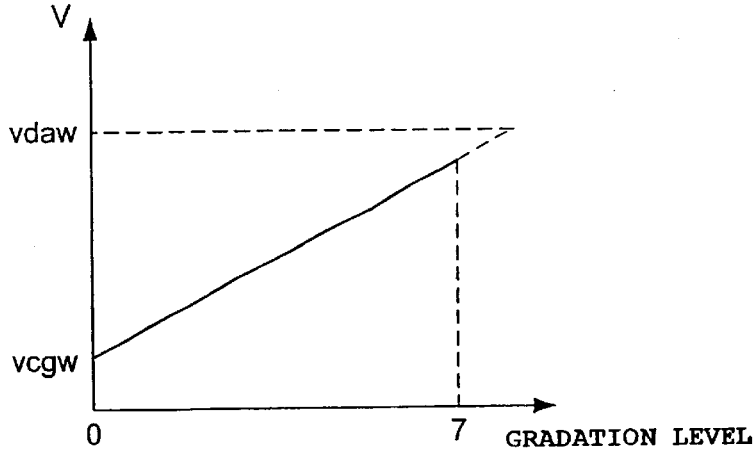
(B)
| GRADATION LEVEL | DAC CAPCITOR | APPLIED VOLTAGE V |
|---|---|---|
| 0 | 0 | vcgw |
| 1 | 1 * C0 | vcgw+{(1*C0)/(7*C0+Cs)}*(vdaw−vcgw) |
| 2 | 2 * C0 | vcgw+{(2*C0)/(7*C0+Cs)}*(vdaw−vcgw) |
| 3 | 3 * C0 | vcgw+{(3*C0)/(7*C0+Cs)}*(vdaw−vcgw) |
| 4 | 4 * C0 | vcgw+{(4*C0)/(7*C0+Cs)}*(vdaw−vcgw) |
| 5 | 5 * C0 | vcgw+{(5*C0)/(7*C0+Cs)}*(vdaw−vcgw) |
| 6 | 6 * C0 | vcgw+{(6*C0)/(7*C0+Cs)}*(vdaw−vcgw) |
| 7 | 7 * C0 | vcgw+{(7*C0)/(7*C0+Cs)}*(vdaw−vcgw) |

[FIG. 7]
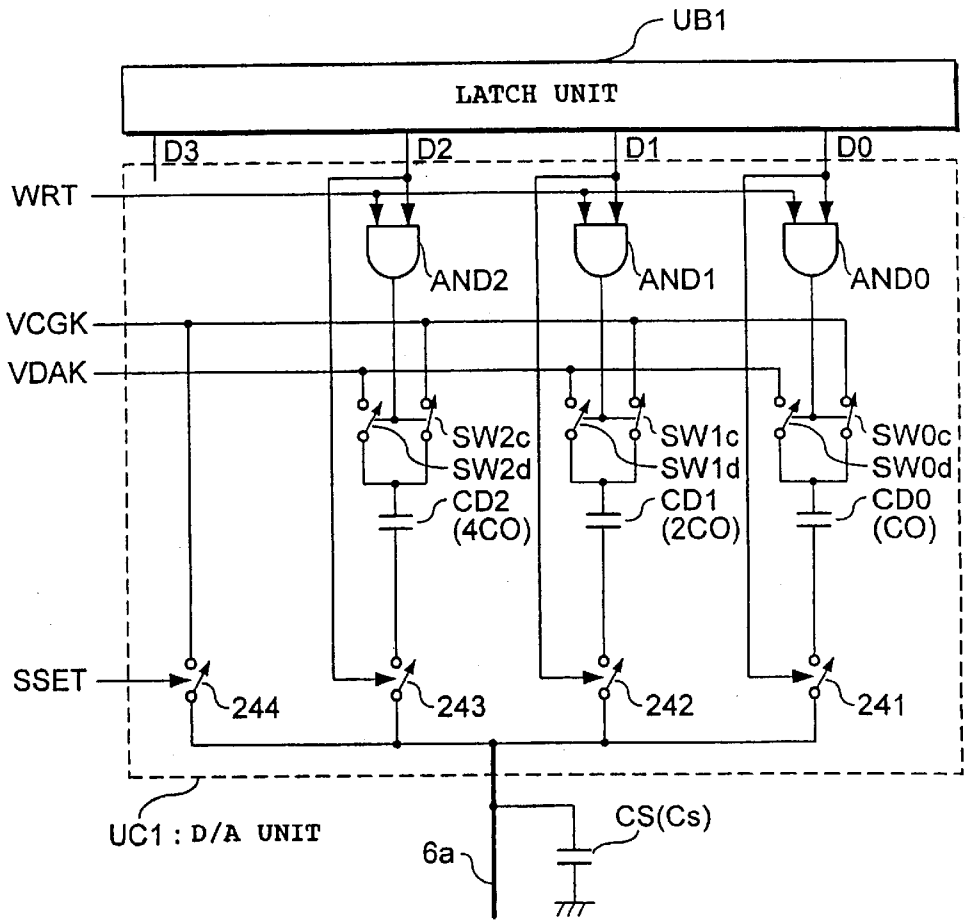

[FIG. 8]
(A)
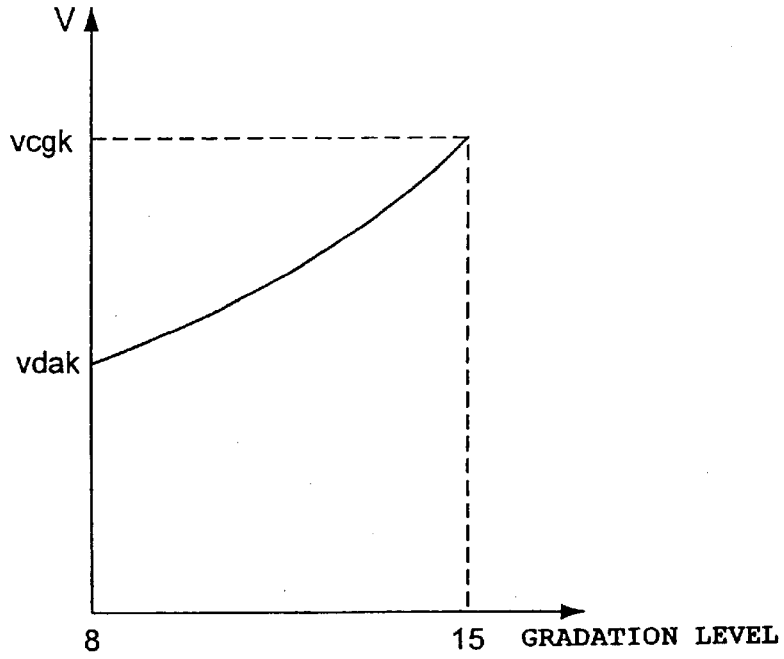
(B)
| GRADATION LEVEL | DAC CAPCITOR | APPLIED VOLTAGE V |
|---|---|---|
| 8 | 0 | vcgk−{(7*C0)／(7*C0＋Cs)}*(vcgk−vdak) |
| 9 | 1 * C0 | vcgk−{(6*C0)／(6*C0＋Cs)}*(vcgk−vdak) |
| 10 | 2 * C0 | vcgk−{(5*C0)／(5*C0＋Cs)}*(vcgk−vdak) |
| 11 | 3 * C0 | vcgk−{(4*C0)／(4*C0＋Cs)}*(vcgk−vdak) |
| 12 | 4 * C0 | vcgk−{(3*C0)／(3*C0＋Cs)}*(vcgk−vdak) |
| 13 | 5 * C0 | vcgk−{(2*C0)／(2*C0＋Cs)}*(vcgk−vdak) |
| 14 | 6 * C0 | vcgk−{(1*C0)／(1*C0＋Cs)}*(vcgk−vdak) |
| 15 | 7 * C0 | vcgk |

[FIG. 9]
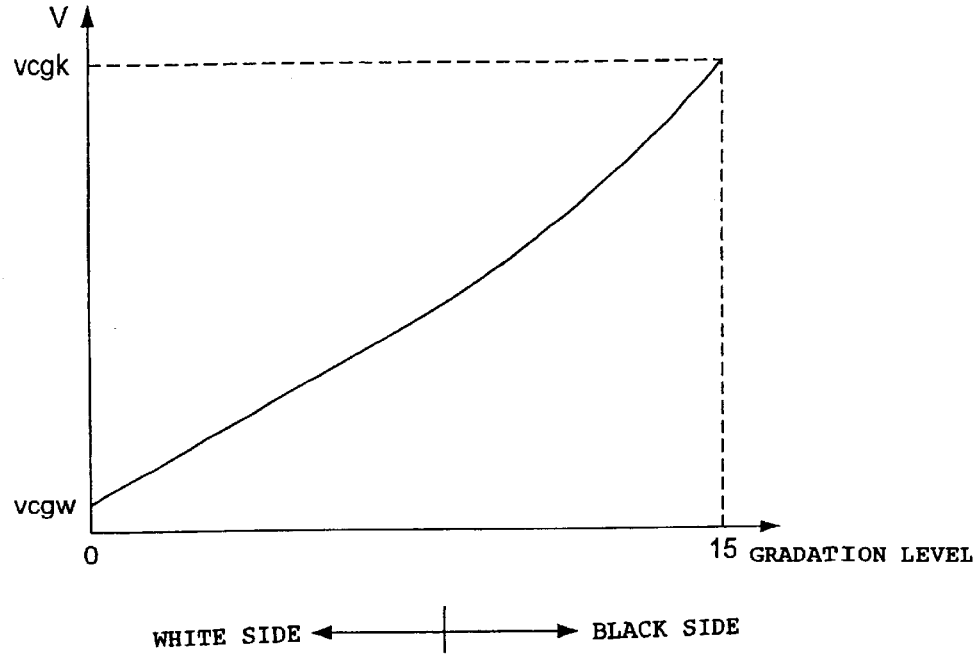

[FIG. 10]
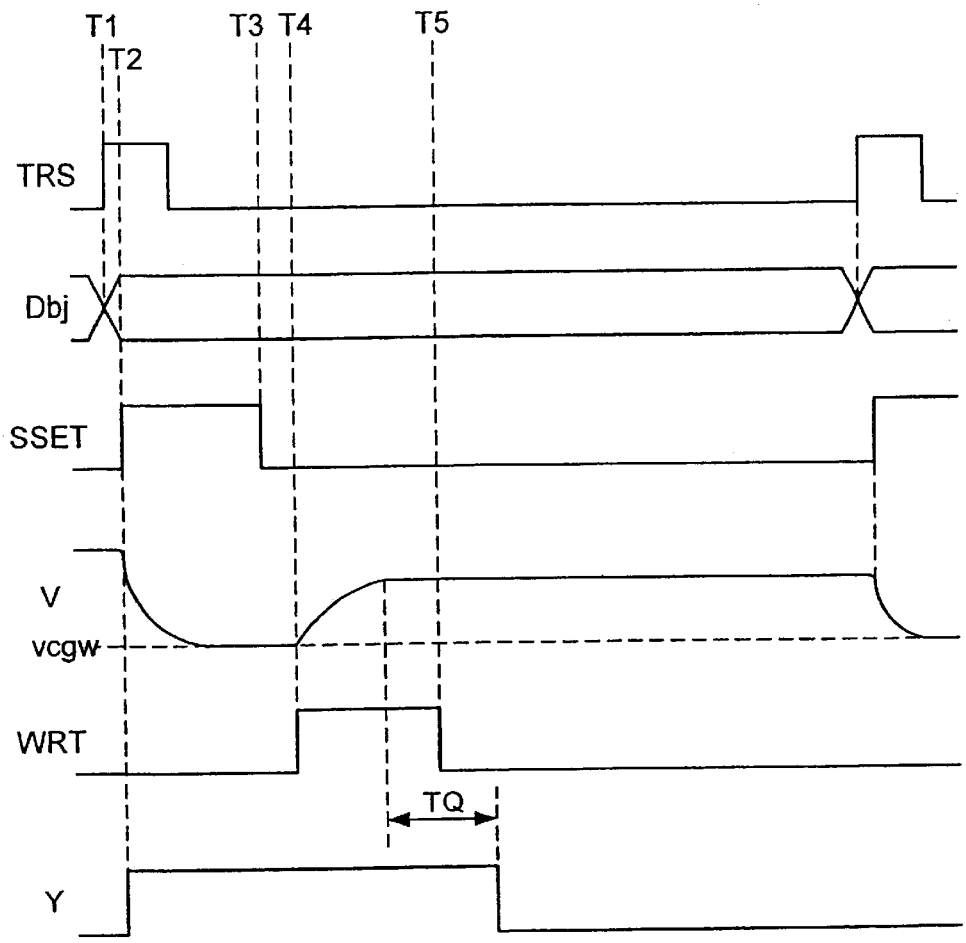

[FIG. 11]
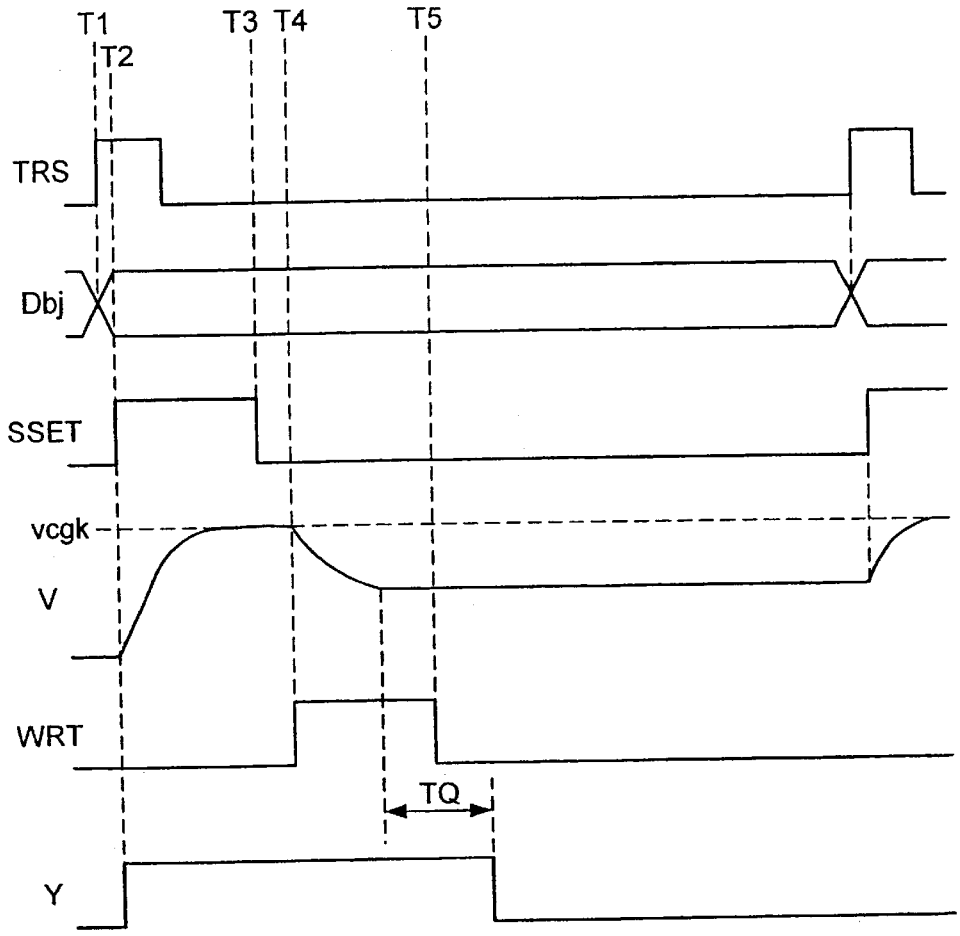

[FIG. 12]
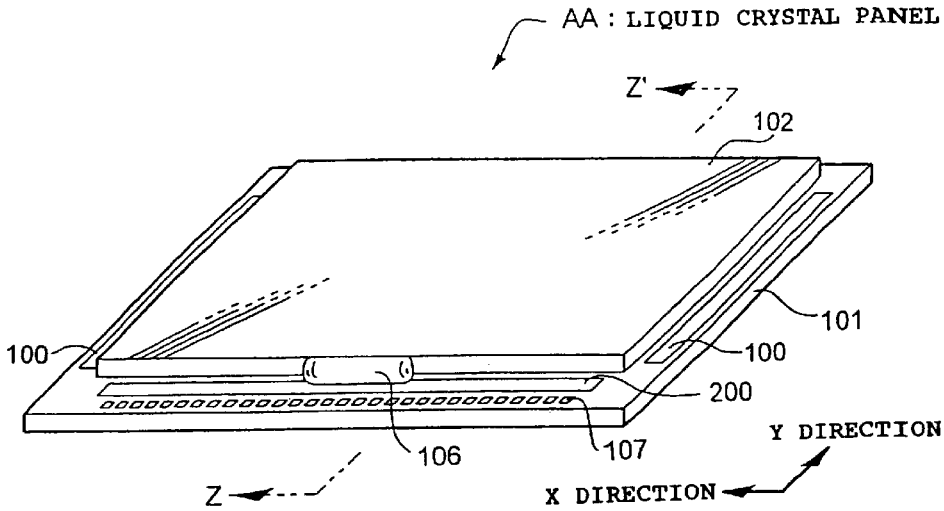
[FIG. 13]
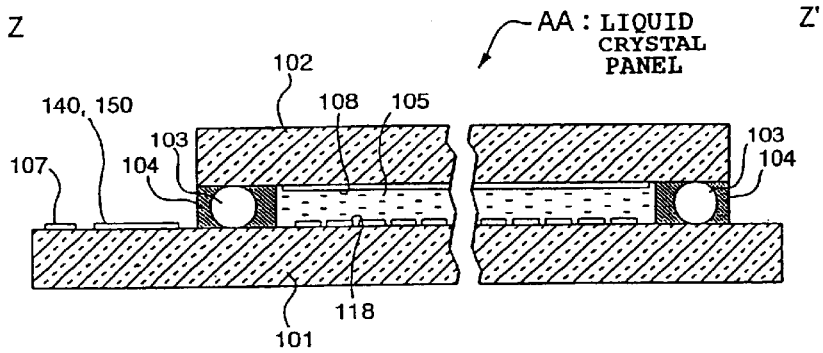

[FIG. 14]
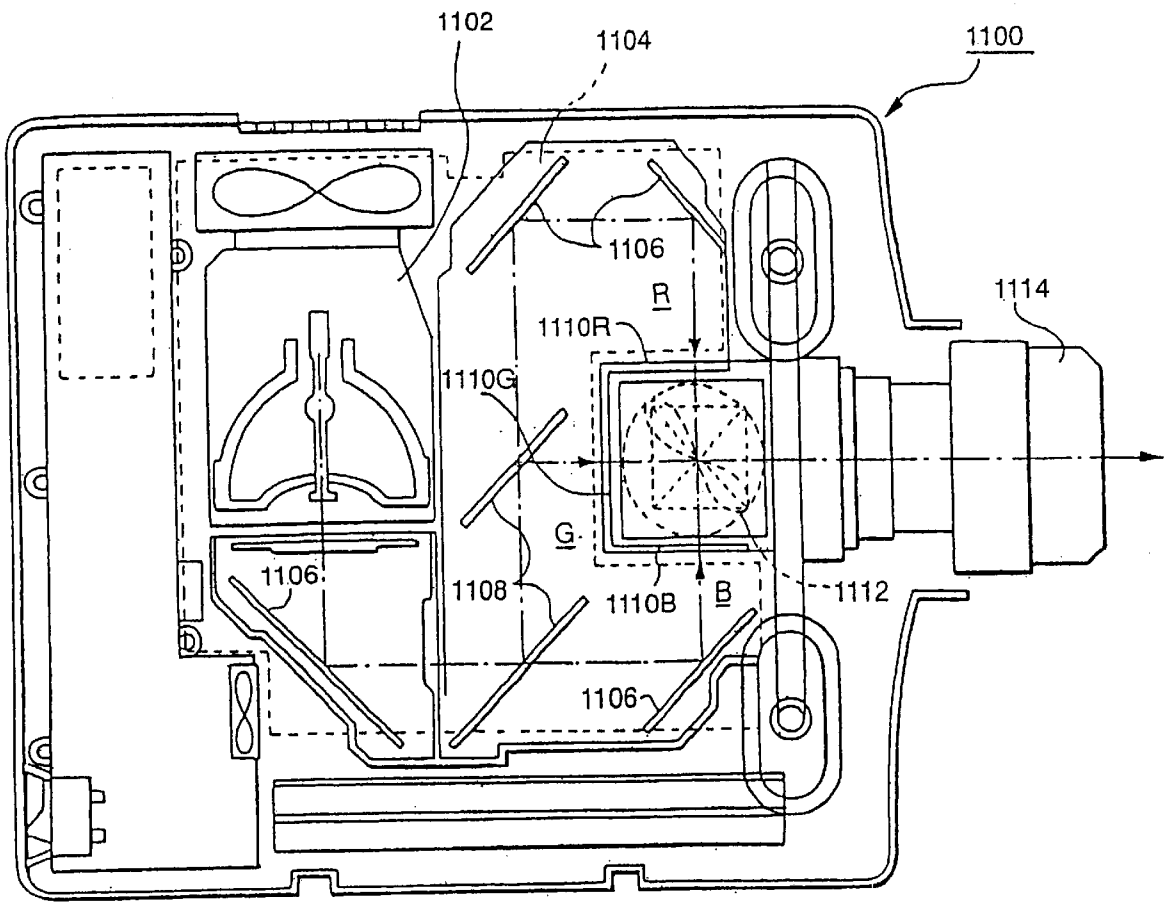

[FIG. 15]
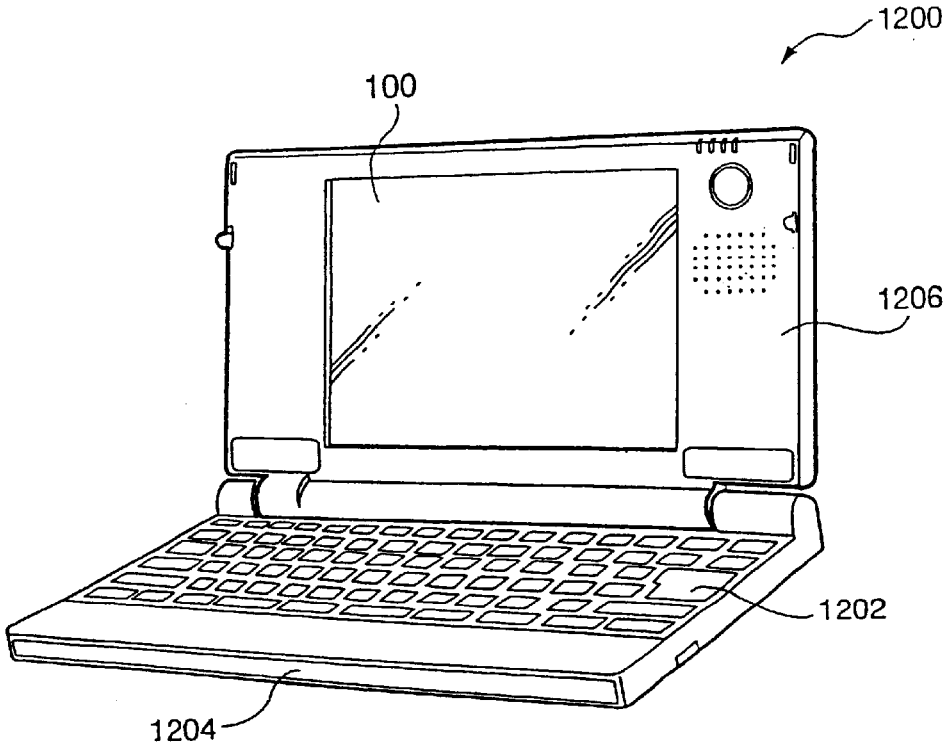
[FIG. 16]
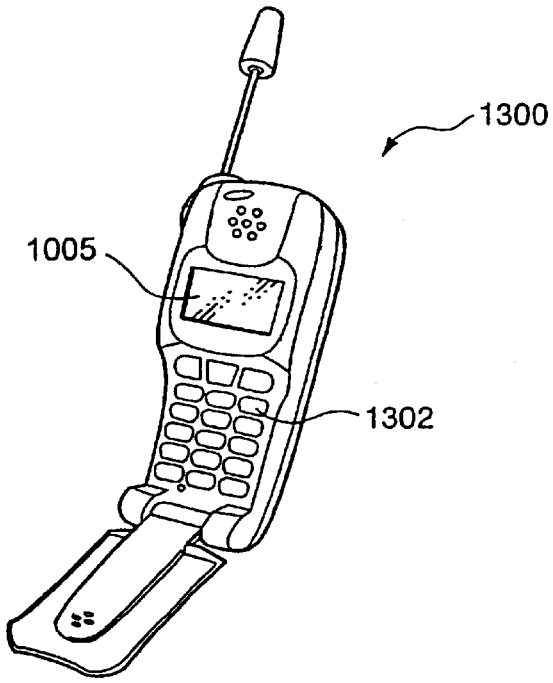

[FIG. 17]
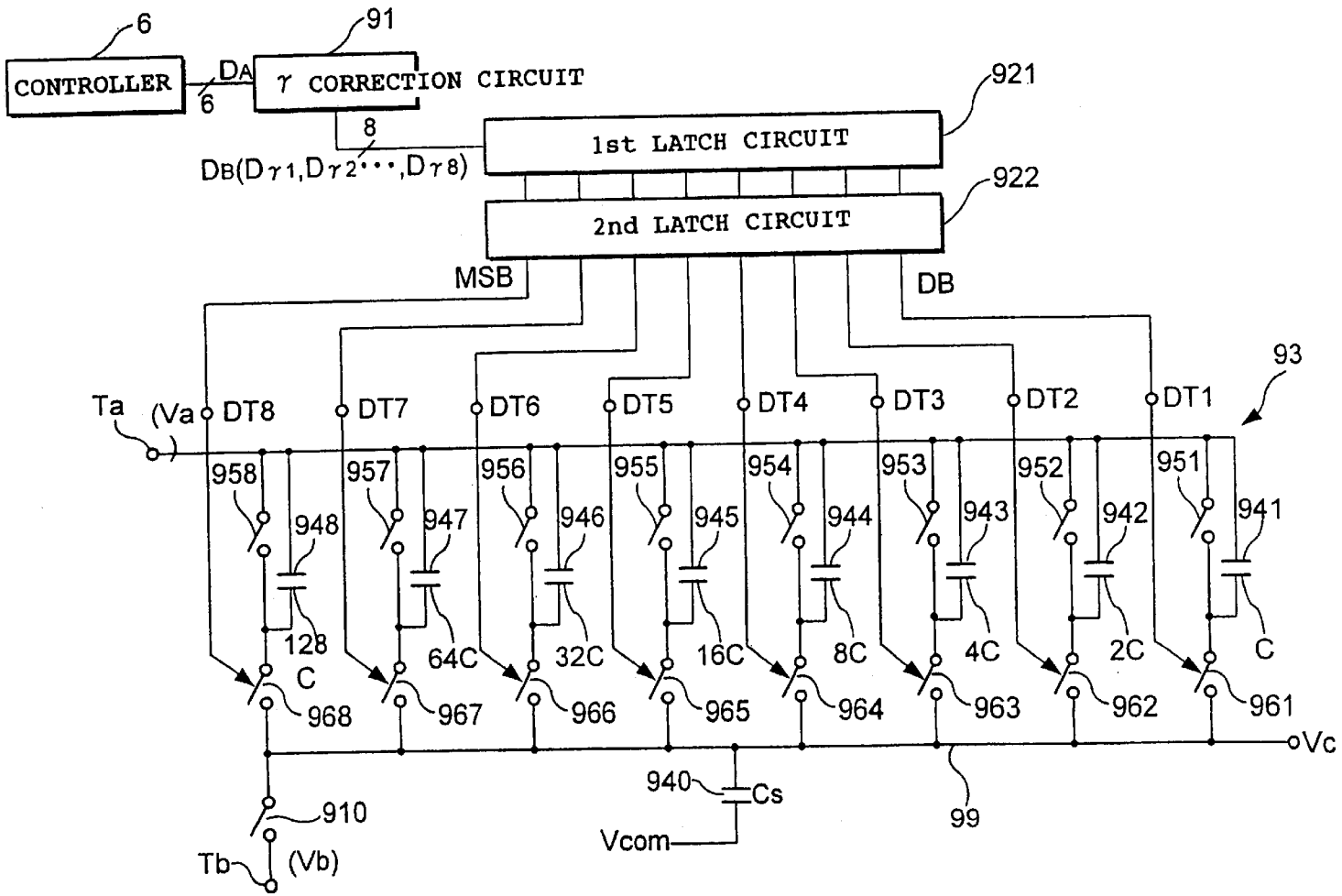

[FIG. 18]
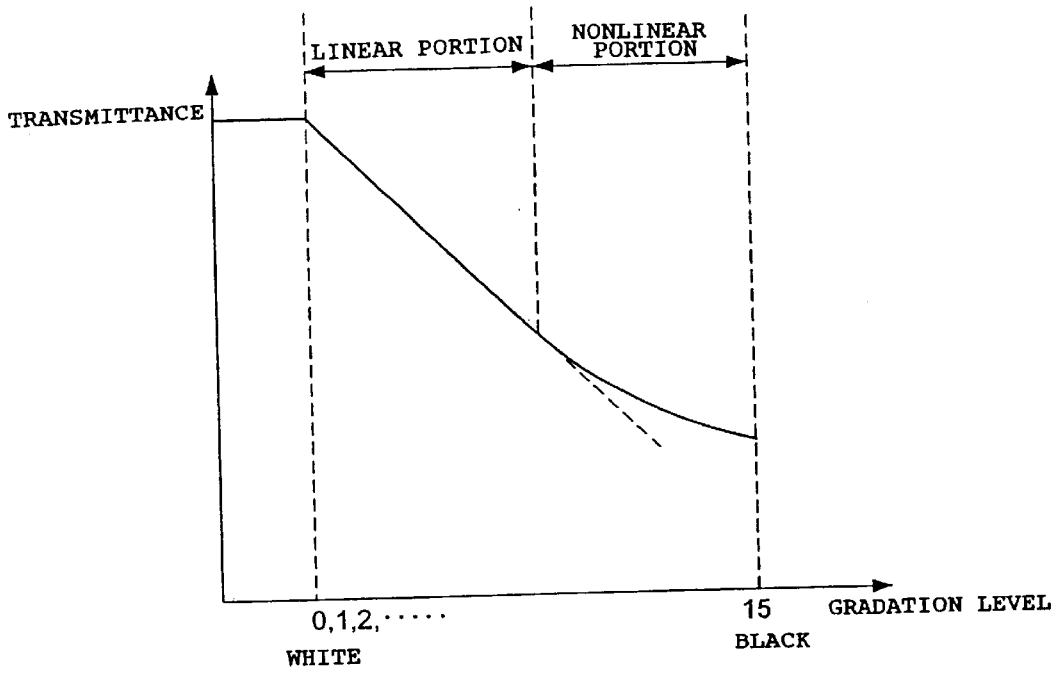

METHOD FOR DRIVING ELECTRO-OPTICAL PANEL, DATA LINE DRIVING CIRCUIT THEREOF, ELECTRO-OPTICAL APPARATUS, AND ELECTRONIC EQUIPMENT

BACKGROUND OF THE INVENTION

1. Field of Invention

The present invention generally relates to a method for driving an electro-optical panel, a data line driving circuit thereof, an electro-optical apparatus, and electronic equipment.

2. Description of Related Art

Generally, an image display portion of a liquid crystal display apparatus includes an element substrate, an opposing substrate, and liquid crystal enclosed in a gap defined between these substrates. A plurality of scanning lines, a plurality of data lines, transistors provided correspondingly to the intersections of the scanning lines and the data lines, and pixel electrodes are formed on the element substrate. On the other hand, a common electrode is formed on the opposing substrate. Further, thin film transistors (hereunder referred to as "TFTs") are used as the transistors.

Each TFT has a gate connected to a scanning line, a source connected to a data line, and a drain connected to a pixel electrode.

Generally, a method for driving this image display portion includes simultaneously turning on a plurality of TFTs by selecting scanning lines with predetermined timing, and then applying a voltage of each of the data lines to the pixel electrodes simultaneously. In this case, voltages corresponding to image data are supplied to the data lines, respectively. The transmittance of the liquid crystal is controlled according to the voltage applied between the pixel electrode and the common electrode. This enables gray scale display according to the values of image data.

The relationship between the voltage applied to the liquid crystal and the transmittance thereof (hereunder referred to as "V-T characteristic") is not a linear relation but a non-linear relation. Therefore, it is necessary to perform an operation of making the quantity of change in transmittance of the liquid crystal uniform, correspondingly to each gray scale level of image data. In the present application, this operation is referred to as a γ-correction.

FIG. 17 is a block diagram illustrating a data line driving circuit for driving one data line, and peripheral circuits thereof. As shown in this figure, the data line driving circuit includes a first latch circuit 921, a second latch circuit 922, and a DA converter 93. Further, a controller 6 and a γ-correction circuit 91 are provided at a preceding stage of this data line driving circuit.

The controller 6 generates 6-bit image data DA. The γ-correction circuit 91 performs γ-correction on the image data DA and generates 8-bit image data DB (Dγ1, Dγ2, . . . , Dγ8). Incidentally, the γ-correction circuit 91 includes a RAM or a ROM, in which a table for performing γ-correction is stored. Data stored in this table is determined according to the input-output characteristic of the DA converter 93, and the transmittance-applied-voltage characteristic of the liquid crystal.

The DA converter 93 is a capacitance division DA converter using switches and capacitors. The DA converter 93 has 8 parallel-placed capacitive devices 941 to 948. If "C" represents the value of capacity of the capacitive device 941, then the capacitive devices 942, 943, . . . , 948 are selected so that the values of these capacitive devices are 2C, 4C, . . . , and 128C, respectively.

Further, data line capacitance 940 is parasitic on a data line 99. In FIG. 17, the value of this parasitic capacitance is indicated by Cs. A voltage Vcom at a terminal, which is at the side opposite to the data line 99, of an equivalent capacitor having capacitance equal to the data line capacitance 940 is applied to the common electrode placed on the opposing substrate.

Two reference voltages Va and Vb are supplied to the DA converter 93. One terminal of each of the capacitive devices 941 to 948 is connected to a supply terminal Ta for supplying the reference voltage Va. On the other hand, the other terminal of each of the capacitive devices 941 to 948 is connected to the supply terminal Ta through a corresponding one of reset switches 951 to 958. When the switches 951 to 958 are on, both terminals of each of the capacitive devices 941 to 948 are short-circuited, so that the charged electricity of the capacitive devices 941 to 948 is discharged therefrom. Further, a reset switch 910 is connected to between a terminal for supplying the other reference voltage Vb and the data line 99. When this switch 910 is on, the electric potential of the data line 99 is reset to a level corresponding to the voltage Vb.

Additionally, each of switches 961 to 968, which is adapted to be on or off according to the value of a corresponding one of data Dγ1 to Dγ8, is provided between the data line 99 and a corresponding one of the capacitive devices 941 to 948. When switches 961 to 968 are selectively turned on, the capacitive devices connected to the switches, which are turned on, are parallel-connected to one another. Thus, a voltage corresponding to image data DB is applied to the data line 99.

Meanwhile, in recent years, liquid crystal exhibiting a nearly linear V-T characteristic has been developed by improving the composition thereof. It has been known that, especially, in the case of certain TN (Twisted Nematic) liquid crystal, as shown in a graph of FIG. 18, the V-T characteristic thereof almost rectilinearly (or linearly) changes at the white side, while such a characteristic thereof curvedly (or non-linearly) changes at the black side.

When the liquid crystal whose V-T characteristic having both of a linear portion and a non-linear portion is driven, it is considered that the liquid crystal is driven by assuming that the V-T characteristic thereof linearly changes. In this case, although the γ-correction circuit 91 can be omitted, the gray scale level of an actually displayed image is higher than that of an original image to be displayed, because the relation between the transmittance and the applied voltage is actually a non-linear relation at the black side. Thus, this conventional liquid crystal has a drawback in that the original image cannot be displayed with proper gray scale levels at the black side. Additionally, this conventional liquid crystal has other drawbacks in that the contrast ratio of a display using this liquid crystal is decreased, and that the picture quality thereof is degraded.

Conversely, in the case of performing γ-correction by using the γ-correction circuit 91, none of such drawbacks occur, because preliminarily γ-corrected image data is supplied to the data line driving circuit. However, a primary part of the γ-correction circuit 91 includes the RAM or ROM, as described above. Moreover, peripheral circuits, such as a read circuit, are necessary. Thus, such a conventional liquid crystal display unit has a drawback in that when the γ-correction circuit 91 is used, the cost and power-consumption thereof are increased.

SUMMARY OF THE INVENTION

The present invention is accomplished in view of the aforementioned circumstances. Accordingly, an object of the present invention is to provide a data line driving circuit of an electro-optical panel, which has a circuit having a small occupied area and can be driven with low power consumption, and to provide a driving method therefor, and to provide an electro-optical apparatus, and to provide electronic equipment.

To achieve the foregoing object, according to an aspect of the present invention, there is provided a method for driving an electro-optical panel on the precondition that this method is used in an electro-optical panel having an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto. This method includes the step of determining, according to a value of a predetermined bit of image data to be displayed, which of the linear portion and the non-linear portion of the characteristic the image data corresponds to, the step of supplying a first voltage to a parasitic capacitance of each of the data lines, the step of charging a quantity of electric charge, on which γ-correction is performed, into the parasitic capacitance of each of the data lines corresponding to a data value of the image data when it is determined that the image data corresponds to the non-linear portion, and the step of charging a quantity of electric charge, on which γ-correction is not performed, corresponding to the data value of the image data into the parasitic capacitance of each of the data lines when it is determined that the image data corresponds to the linear portion.

According to this method of the present invention, even when the transmittance-applied-voltage characteristic of the electro-optical material has the linear portion and the non-linear portion, it is determined which of the linear portion and the non-linear portion the image data to be displayed corresponds to. Further, according to a result of the decision, a predetermined quantity of charge is charged into the parasitic capacitance of the data line. Thus, the γ-correction can be suitably performed. Consequently, the gray scale reproducibility and the contrast ratio of a displayed image can be simultaneously enhanced.

Further, according to another aspect of the present invention, there is provided another method for driving an electro-optical panel on the precondition that this method is used in an electro-optical panel having an electro-optical material, whose transmittance-applied-voltage characteristic has a linear portion and a nonlinear portion, a plurality of scanning lines, a plurality of data lines, switching devices provided correspondingly to intersections between the scanning lines and the data lines, and pixel electrodes provided correspondingly thereto. This method includes the step of determining, according to a value of a predetermined bit of image data to be displayed, which of the linear portion and the non-linear portion of the characteristic the image data corresponds to, and the step of selecting, when it is determined that the image data corresponds to the non-linear portion, from plural inner capacitances provided correspondingly to each of bits other than the predetermined bit of the image data and weighted according to the bit value thereof, the inner capacitances corresponding to a data value represented by the other bits, and charging a quantity of electric charge corresponding to an image data value into each of the selected inner capacitances, and supplying a voltage to each of the data lines by transferring the charge between a parasitic capacitance thereof and each of the selected inner capacitances, and the step of selecting, when it is determined that the image data corresponds to the linear portion, from the plural inner capacitances, the inner capacitances corresponding to the data value represented by the other bits, and charging a quantity of electric charge corresponding to an image data value into each of the selected inner capacitances, and supplying a voltage to each of the data lines by transferring the charge between the parasitic capacitance thereof and each of all of the inner capacitances.

According to this method of the present invention, the inner capacitances can be used for both the cases that the image data to be displayed corresponds to the linear portion (in this case, the γ-correction is not performed on the image data), and that the image data to be displayed corresponds to the non-linear portion (in this case, the γ-correction is performed on the image data). Thus, an image can be displayed by using a simple circuit. Moreover, it is determined which of the linear portion and the non-linear portion the image to be displayed corresponds to. Further, according to a result of this decision, a predetermined quantity of electric charge is charged into the parasitic capacitances of the data lines. Thus, the γ-correction is suitably performed on the image data. Consequently, the gray scale reproducibility and the contrast ratio of a displayed image can be simultaneously enhanced.

Further, according to another aspect of the present invention, there is provided another method for driving an electro-optical panel on the precondition that this method is used in an electro-optical panel having an electro-optical material, whose transmittance-applied-voltage characteristic has a linear portion and a nonlinear portion, a plurality of scanning lines, a plurality of data lines, switching devices provided correspondingly to intersections between the scanning lines and the data lines, and pixel electrodes provided correspondingly thereto. This method includes the step of determining, according to a value of a most significant bit of image data to be displayed, which of the linear portion and the non-linear portion of the characteristic the image data corresponds to, and, the step of selecting, when it is determined that the image data corresponds to the non-linear portion, from plural inner capacitances provided correspondingly to each of low order bits other than the most significant bit of the image data and weighted according to the bit value thereof, the inner capacitances corresponding to a data value represented by the low order bits, and connecting one of terminals of each of the selected inner capacitances to each of the data lines, and supplying a first data line voltage across both terminals of each of the selected inner capacitances and to each of the data lines, and supplying a first inner capacitance voltage to the other terminal of each of the selected inner capacitances, and the step of connecting, when it is determined that the image data corresponds to the linear portion, one of terminals of each of all of the inner capacitances to each of the data lines, and supplying a second data line voltage to the one of terminals thereof and to each of the data lines, selecting from all of the inner capacitances, the inner capacitances corresponding to a data value represented by the low order bits, and supplying a second inner capacitance voltage to the other terminal of each of the selected inner capacitances.

This method of the present invention is suitable especially for the case that the transmittance-applied-voltage characteristic at one of the black side and the white side is non-linear. In the case of employing this method, it is determined according to the most significant bit of the image data whether or not the image data corresponds to the non-linear portion. Thus, the decision can be made by a simple circuit.

Furthermore, according to another aspect of the present invention, there is provided a data line driving circuit for driving data lines of an electro-optical panel on the precondition that this circuit is used in an electro-optical panel having an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto. This circuit includes plural inner capacitances provided correspondingly to each of low order bits other than a most significant bit of the image data and weighted respectively corresponding to bit values thereof, a switching device provided between each of the inner capacitances and a corresponding one of the data lines and controlled in such a manner as to be on or off according to a digit corresponding to each of bits of the image data, a first voltage supply that selects one of a first data line voltage and a second data line voltage according to the most significant bit of the image data and for supplying the selected voltage to one of terminals of each of all of the inner capacitances and to the other terminal of each of the inner capacitances to be connected thereto through the data lines and the switching device, and a second voltage supply that selects one of a first inner capacitance voltage and a second inner capacitance voltage according to the most significant bit of the image data and for supplying the selected voltage to one of terminals of each of the inner capacitances selected according to each of digits of the low order bits.

Generally, when the integration of a circuit is performed, capacitive devices occupy a relatively large area. However, according to this invention, the capacitive devices can be used for both the cases that the γ-correction is performed on the image data, and that the γ-correction is not performed thereon. Consequently, the size of the circuit can be reduced.

In the case of an embodiment of this circuit, preferably, the switching device determines, according to a digit of the most significant bit of the image data, which of the linear portion and the non-linear portion of the characteristic of the electro-optical material the image data to be displayed corresponds to. Further, when the switching device determines that the image data corresponds to the linear portion, the switching device connects one of terminals of each of the inner capacitances to each of the data lines. Moreover, conversely, when the switching device determines that the image data corresponds to the non-linear portion, the switching device selects the inner capacitance corresponding to each of digits of the low order bits and for connecting one of terminals of the selected inner capacitances to each of the data lines. According to this embodiment, even when the transmittance characteristic of the electro-optical material has the linear portion and the non-linear portion, voltage respectively corresponding to these portions can be applied to the data lines. Thus, the gray scale reproducibility and the contrast ratio of a displayed image can be simultaneously and favorably maintained. Consequently, the picture quality thereof can be considerably enhanced.

Furthermore, in the case of an embodiment of this circuit, preferably, the switching device includes plural OR-circuits each for calculating the logical OR of the most significant bit and a corresponding one of the low order bits, and switch circuits each of which is controlled by a corresponding one of the OR circuits in such a manner as to be on or off, and provided between a corresponding one of the inner capacitances and each of the data lines. According to this embodiment, the use of several gates enables the circuit to change the condition thereof between a condition, in which the γ-correction is performed, and another condition, in which the γ-correction is not performed.

Further, according to another aspect of the present invention, there is provided a data line driving circuit for driving data lines of an electro-optical panel on the precondition that this circuit is used in an electro-optical panel having an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto. This circuit includes a shift register that sequentially shifts transfer pulses in every horizontal scanning period and sequentially outputs selection signals, a first latch portion that latches image data according to each of the selection signals and outputs plural dot-sequence image data, a second latch portion that latches each of dot-sequence image data in every horizontal scanning period and outputs plural line-sequence image data, and a DA conversion portion that DA-converts the line-sequence image data. In this circuit, preferably, the DA converting portion includes plural inner capacitances provided correspondingly to each of low order bits other than the most significant bit of the line-sequence image data and weighted respectively corresponding to bit values thereof, a switching device provided between each of the inner capacitances and a corresponding one of the data lines and controlled in such a manner as to be on or off according to a digit corresponding to each of bits of the line-sequence image data, a first voltage supply that selects one of a first data line voltage and a second data line voltage according to the most significant bit of the line-sequence image data and supplies the selected voltage to one of terminals of each of all of the inner capacitances and to the other terminal of each of the inner capacitances to be connected thereto through the data lines and the switching device, and a second voltage supply device that selects one of a first inner capacitance voltage and a second inner capacitance voltage according to the most significant bit of the line-sequence image data and supplies the selected voltage to one of terminals of each of the inner capacitances selected according to each of digits of the low order bits.

Moreover, according to another aspect of the present invention, there is provided an electro-optical apparatus that includes an electro-optical panel having an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto, the herein-above-mentioned data line driving circuit, and a scanning line driving circuit adapted to sequentially generate scanning line signals for selecting the scanning lines and to output the generated scanning line signal to each of the scanning lines.

According to this apparatus, there is no particular necessity for providing the γ-correction circuit, Thus, the size of the entire circuit of the apparatus can be reduced. Additionally, this reduction in size results in decrease in the power consumption thereof.

Furthermore, according to another aspect of the present invention, there is provided electronic equipment that includes the aforementioned electro-optical apparatus of the present invention as a display portion. Thus, the present invention can provide electronic equipment with a lower-power-consumption compact display unit. Incidentally, such electronic equipment can be, for example, an engineering workstation, a pager, a hand portable telephone set, a television set, a view-finder or monitor direct view camcorder, or a car navigation system.

BRIEF DESCRIPTION OF THE DRAWINGS

FIG. 1 is a block diagram illustrating the entire configuration of a liquid crystal display device according to an embodiment of the present invention;

FIG. 2 is a block diagram illustrating the configuration of a data line driving circuit 200 used in this embodiment;

FIG. 3 is a timing chart illustrating various types of signals of the data line driving circuit;

FIG. 4 is a block diagram illustrating the configuration of a D/A unit UCI and peripheral circuits thereof;

FIG. 5 is a diagram illustrating an equivalent circuit in the case that the digit of the most significant bit D3 in the D/A unit is "0";

FIG. 6(A) is a graph illustrating the relationship between the values of the gray scale level and the voltage V applied to the data line 6*a* in the case that the most significant bit D3 is "0"; and FIG. 6(B) is a table describing the relation among the value of the gray scale level, a total sum of the selected DAC capacitances, and the value of the voltage of the data line 6*a;*

FIG. 7 is a diagram illustrating an equivalent circuit in the case that the digit of the most significant bit D3 in the D/A unit is "1";

FIG. 8(A) is a graph illustrating the relation between the values of the gray scale level and the voltage V applied to the data line 6*a* in the case that the most significant bit D3 is "1"; and FIG. 8(B) is a table describing the relation among the value of the gray scale level, a total sum of the selected DAC capacitances, and the value of the voltage of the data line 6*a;*

FIG. 9 is a graph illustrating the overall characteristic of the D/A unit;

FIG. 10 is a timing chart illustrating an operation of the data line driving circuit in the case that the most significant bit of the image data Dbj is "0";

FIG. 11 is a timing chart illustrating an operation of the data line driving circuit in the case that the most significant bit of the image data Dbj is "1";

FIG. 12 is a perspective diagram illustrating the configuration of a liquid crystal panel;

FIG. 13 is a sectional diagram taken along plane Z-Z' of FIG. 12;

FIG. 14 is a sectional diagram illustrating the configuration of a projector that is an example of electronic equipment to which the liquid crystal display device of the present invention is applied;

FIG. 15 is a perspective diagram illustrating the configuration of a personal computer that is an example of electronic equipment to which the liquid crystal display device of the present invention is applied;

FIG. 16 is a perspective diagram illustrating the configuration of a hand portable telephone set that is an example of electronic equipment to which the liquid crystal display device of the present invention is applied;

FIG. 17 is a block diagram illustrating a data line driving circuit for driving a single data line, and peripheral circuits thereof; and FIG. 18 is a graph illustrating an example of the V-T characteristics of TN liquid crystal.

DETAILED DESCRIPTION OF PREFERRED EMBODIMENTS

Hereinafter, embodiments of the present invention are described hereinbelow with reference to the accompanying drawings.

<1. Configuration of Liquid Crystal Display Device>

<1-1. Entire Configuration of Liquid Crystal Display Device>

First, a liquid crystal display device using liquid crystal as an electro-optical material, which is an embodiment of an electro-optical apparatus according to the present invention, is described hereinbelow by way of example. A primary part of the liquid crystal display device includes a liquid crystal panel AA that is formed by attaching an element substrate and an opposing substrate so that the surfaces, on which electrodes are formed, of these substrates face each other, and that a uniform gap is provided therebetween, and that liquid crystal is filled in this gap and sandwiched therebetween. TFTs are formed on the element substrate as switching devices. Although a glass substrate is used as the element substrate in this embodiment, needless to say, a semiconductor substrate or a plastic substrate may be used as the element substrate.

FIG. 1 is a block diagram illustrating the entire configuration of a liquid crystal display device according to this embodiment of the present invention. The liquid crystal display device includes a liquid crystal panel AA and external processing circuits. An image display region A, a scanning line driving circuit 100, and a data line driving circuit 200 are formed on the element substrate of the liquid crystal panel AA. Among these, the data line driving circuit 200 is adapted in such a manner as not to perform γ-correction when image data to be displayed corresponds to the linear portion of the V-T characteristic of the liquid crystal. Conversely, when the image data corresponds to the non-linear portion of the V-T characteristic, the γ-correction is performed thereon, so that data line signals X1 to Xn are generated. Incidentally, active devices of each of circuits formed on the element substrate are constituted by TFTs.

Further, the liquid crystal display device includes a timing generating circuit 300, a power supply circuit 400, and an image data converting circuit 500.

Input image data Din supplied to this liquid crystal display device is in, for example, a parallel format. Further, the number of bits of the input image data is an arbitrary number. Needless to say, the input image data may be in a serial format. However, in the following description, it is assumed that the input image data Din is in a 4-bit parallel format in this embodiment. Moreover, for brevity of description, it is also assumed that the input image data Din corresponds to a single color. However, the present invention is not limited thereto. Needless to say, the image data Din may be set in such a way as to correspond to three RGB primary colors.

First, the image data converting circuit 500 controls, according to the digit of the most significant bit of the input image data Din, whether or not the other low order bits other than the most significant bit are inverted. Practically, the low order bits are inverted when the digit of the most significant bit is "1", so that data obtained by such inversion is outputted as image data D, while the input image data Din is output as image data D when the most significant bit has a digit "0". It is sufficient that the image data converting circuit 500 has exclusive-OR circuits respectively corresponding to the low order bits other than the most significant bit, and that each of the exclusive-OR circuits calculates the exclusive-OR of the most significant bit and a corresponding bit. Thus, the image data converting circuit 500 may comprises three exclusive-OR circuits.

Next, the timing generating circuit 300 generates a Y clock YCK, an X clock XCK, a Y transfer starting signal DY, an X transfer starting signal DX, and a latch pulse TRS in synchronization with the input image data D. Further, the timing generating circuit 300 supplies these signals to the scanning line driving circuit 100 and the data line driving circuit 200.

Moreover, the power supply circuit 400 includes a constant-voltage circuit. The power supply circuit 400 generates a power supply voltage for each of the circuits formed on the element substrate of the liquid crystal panel AA. Additionally, the power supply circuit 400 generates a white side data line setting voltage VCGW, a white side DAC setting voltage VDAW, a black side data line setting voltage VCGK, and a black side DAC setting voltage VDAK.

<1-2. Image Display Region>

The image display region A has m scanning lines 3*a*, which are formed in such a way as to be arranged along the X-direction in parallel with one another, and n data lines 6*a* that are formed in such a way as to be arranged along the Y-direction in parallel with one another.

As shown in FIG. 1, in the vicinity of the intersections between the scanning lines 3*a* and the data lines 6*a*, the gate of each of the TFTs 50 is connected to the scanning line 3*a*, while the source thereof is connected to the data lines 6*a*, and the drain thereof is connected to the pixel electrode 9*a* thereof. Further, each of pixels has a pixel electrode 9*a*, a counter electrode formed on the opposing substrate, and liquid crystal sandwiched between the pixel electrode 9*a* and the counter electrode. Consequently, pixels are arranged in a matrix-like manner correspondingly to each of the intersections between the scanning lines 3*a* and the data lines 6*a*.

Furthermore, scanning line signals Y1, Y2, . . . , Ym are applied in line sequence like pulses to the scanning lines 3*a*, to which the gates of the TFTs 50 are respectively connected. Thus, when a scanning line signal is supplied to a certain scanning line 3*a*, the TFT 50 connected to this scanning line is turned on. Therefore, data line signals X1, X2, . . . , Xn supplied from the data lines 6*a* with predetermined timing are written to the corresponding pixels in sequence and thereafter, held therein for a predetermined time.

At that time, according to the level of the voltage applied to each of the pixels, the orientation and order of a corresponding liquid crystal molecule change, so that the gray scale display is enabled by light modulation. For example, a quantity of light passing through the liquid crystal is limited with increase in the applied voltage in the case of a normally white mode, while the limitation to such a quantity of light is mitigated with increase in the applied voltage in the case of a normally black mode. Thus, in the whole liquid crystal display device, light rays having a contrast ratio corresponding to the image signals are respectively outputted from the pixels. This enables the predetermined display of the image data. The image display region A of this embodiment is constructed in such a manner as to operate in the normally white mode.

Further, to prevent the held image signal from leaking, storage capacitor 51 is added thereto in parallel with the liquid crystal capacity formed between the pixel electrode 9*a* and the counter electrode. For instance, the voltage of the pixel electrode 9*a* is held for a time whose duration is longer than the time, in which a source voltage is applied thereto, by three orders of magnitude. Thus, the holding characteristic is improved. Consequently, a high contrast ratio is realized.

<1-3. Scanning Line Driving Circuit>

Further, the scanning line driving circuit 100 has a Y shift register and a level shifter. The Y shift register, whose period is a vertical scanning period, shifts a Y transfer starting pulse DY, which becomes active when the vertical scanning period begins, by using a Y clock YCK inverted every horizontal scanning time. The level shifter performs the level shifting of each of signals sequentially shifted to thereby generate the scanning line signals Y1, Y2 . . . , Ym. The scanning line signals Y1, Y2, . . . , Ym are supplied like pulses in line sequence to the scanning lines 3*a*.

<1-4. Data Line Driving Circuit>

Next, the data line driving circuit 200 is described hereinbelow. FIG. 2 is a block diagram illustrating the configuration of the data line driving circuit 200. FIG. 3 is a timing chart of various types of signals in the data line driving circuit 200. As illustrated in FIG. 2, the data line driving circuit 200 has an X shift register 210, image data supply lines Ld0 to Ld3 to which image data D0 to D3 are supplied, switches SW10 to SWn3, a first latch portion 220, a second latch portion 230, and a D/A converter portion 240.

The data D0 to D3 respectively representing bit value of the image data D are supplied to the image data supply lines Ld0 to Ld3.

The X shift register 210 is constituted by performing multistage connection of latch circuits. As illustrated in FIG. 3, this X shift register 210 sequentially shifts X transfer starting signals DX according to X clocks XCK to thereby generate sampling pulses SR1, SR2, . . . , SRn.

Furthermore, the switches SW10 to SWn3 illustrated in FIG. 2 are constituted by TFTs. Further, the switches SW10 to SWn3 are divided into groups each having four switches, that is, SW10 to SW13, SW20 to SW23, . . . , SWn0 to SWn3. Hereunder, such groups of switches will be referred to as "switch groups". The number of switch groups corresponds to the number of rows of pixels in the image display region A, that is, "n". Furthermore, the switches of each of the switch groups are connected to the image data supply lines Ld0 to Ld3, respectively. Moreover, n sampling pulses SR1, SR2, . . . , SRn are supplied to the switch groups. Therefore, the image data supply lines D0 to D3 are taken into the first latch portion 220 in synchronization with the sampling pulses SR1, SR2, . . . , SRn.

Further, the first latch portion 220 includes n latch units UA1 to UAn. Each of the latch units UA1 to UAn latches image data D0 to D3 supplied from the switch groups. Thus, image data Da1 to Dan to be scanned in dot sequence as illustrated in FIG. 3 are obtained.

Moreover, the second latch portion 230 shown in FIG. 2 includes n latch units UB1 to UBn. Each of the latch units UB1 to UBn is configured in such a way as to latch output data of the first latch portion 220 in synchronization with latch pulses TRS. The latch pulse TRS is a signal which becomes active in every horizontal scanning period. Therefore, this second latch portion 230 converts the data, which are outputted in dot sequence from the first latch portion 220, into line-sequence image data Db1 to Dbn (see FIG. 3). In other words, the image data D0 to D3 are converted into line sequence image data by using the first latch portion 220 and the second latch portion 230.

Further, a D/A converter portion 240 shown in FIG. 2 has n D/A units UC1 to Ucn, each of which is constituted by the same device. The D/A converter portion 240 is adapted to DA-convert the image data without performing γ-correction when the values represented by the image data Db1 to Dbn are at the white side. Conversely, when such data values are at the black side, the D/A converter portion 240 is adapted to DA-convert the image data Db1 to Dbn by simultaneously performing γ-correction, to thereby generate data line signals X1 to Xn.

<1-5. D/A Unit>

Next, the D/A units UC1 to Ucn are described hereinbelow in detail.

<1-5-1. Entire Configuration of D/A Unit>

FIG. 4 is a block diagram illustrating the configuration of the D/A unit UC1 and peripheral circuits thereof. Other D/A units are constructed in such a way as to be similar to the unit UC1. Thus, the description of such D/A units is omitted herein.

As illustrated in this figure, the D/A unit UC1 has switches SWck, SWcw, SWdk, and SWdw. These switches are controlled according to the most significant bit D3 of the image data Db1 in such a way as to be on or off. Practically, when the most significant bit D3 is "0", the switches SWcw and SWdw are in an on-state. On the other hand, the switches SWck and SWdk are in an off-state. Furthermore, conversely, when the most significant bit D3 is "1", the switches SWck and Swdk are put into an on-state, while the switches SWcw and SWdw are brought into an off-state.

Therefore, when the most significant bit D3 is "0", that is, when the value of the image data Db1 is at the white side, a white side data line setting voltage VCGW and a white side DAC setting voltage VDAW are selected. On the other hand, when the most significant bit D3 is "1", that is, when the value of the image data Db1 is at the black side, the black side data line setting voltage VCGK and the black side DAC setting voltage VDAK are selected.

Further, the D/A unit UC1 has a data line selecting switch 244. When a data line setting signal SSET is active, the data line selecting switch 244 is in an on-state (corresponding to "1"). When the signal SSET is inactive, the switch 244 is in an off-state. Thus, when the data line setting signal SSET is active, the white side data line setting voltage VCGW or the black side data line setting voltage VCGK is supplied to the data line 6*a*. The data line capacitance CS is charged.

Additionally, the D/A unit UC1 has AND circuits AND0 to AND2, switches SW0*c*, SW0*d*, SW1*c*, SW1*d*, SW2*c*, and SW2*d*, DAC capacitances CD0 to CD2, an inverter INV, OR circuits OR0 to OR2, and γ-correction switches 241 to 243.

A write signal WRT is supplied to one of input terminals of each of the AND circuits AND0 to AND2. The first bit D0 to the third bit D2 of the image data Db1 are supplied to the other input terminal thereof. Incidentally, the write signal WRT becomes active (corresponding to "1") for a predetermined time after the active period of the data setting signal SSET. Each of the AND circuits AND0 to AND2 outputs the first bit D0 to the third bit D2 to the switches SW0*c*, SW0*d*, SW1*c*, SW1*d*, SW2*c*, and SW2*d* when the write signal WRT represents "1".

The switches SW0*c*, SW1*c*, and SW2*c* are put into an off-state when each of output signals of the AND circuits AND0 to AND2 represents "1". Conversely, when each of the output signals thereof represents "0", the switches SW0*c*, SW1*c*, and SW2*c* are put into an on-state. On the other hand, the switches SW0*d*, SW1*d*, and SW2*d* are put into an off-state when each of output signals of the AND circuits AND0 to AND2 represents "0". Conversely, when each of the output signals thereof represents "1", the switches SW0*c*, SW1*c*, and SW2*c* are put into an on-state.

The logical level indicated by the write signal WRT is "0" during the data line setting signal SSET is active. Thus, during this state, the switches SW0*c*, SW1*c*, and SW2*c* are brought into an on-state. Then, the white side data line setting voltage VCGW or the black side data line setting voltage VCGK is supplied to one of the terminals of each of the DAC capacitances CD0 to CD2. That is, during the data line setting signal SSET is active, the inter-terminal voltage of each of the DAC capacitances CD0 to CD2 is 0 V.

Moreover, in the write period, during which the logical level of the write signal is "1", among the DAC capacitances CD0 to CD2, the white side DAC setting voltage VDAW or the black side DAC setting voltage VDAK is applied only to the capacitances, the digit of a corresponding one of the first to third bits D0 to D2 of which is "1".

Furthermore, the γ-correction switches 241 to 243 are put into an on-state when the logical level of the control input terminal thereof is "1". Conversely, when the logical level thereof is "0", the switches 241 to 243 are put into an off-state. Further, the most significant bit D3 is inverted and inputted to one of the input terminals of each of the OR circuits OR1 to OR2 through the inverter INV. Therefore, when the digit of the most significant bit D3 of the image data Db1 is "1", the γ-correction switches 241 to 243 are controlled in such a way as to be on or off according to the first bit D0 to the third bit D2. On the other hand, when the digit of the most significant bit D3 is "0", all the switches 241 to 243 are brought into an on-state.

<1-5-3. Equivalent Circuit of D/A Unit>

(1) In the case that the digit of the most significant bit D3 is "0"

First, consideration is given to the case that the digit of the most significant bit D3 is "0". In this case, the data value of the image data Db1 ranges from "0000" to "0111", which correspond to white side levels.

FIG. 5 illustrates an equivalent circuit of the D/A unit in the case that the digit of the most significant bit D3 is "0".

This equivalent circuit operates as follows. First, the data line selecting signal SSET becomes active. The white side data line setting voltage VCGW is supplied to the data lines capacitance CS. At that time, the voltage of the data line 6*a* and the voltage developed across each of the DAC capacitances CD0 to CD2 are the voltage VCGW at a first step.

The switches SWck and SWcw select one of the white side data line setting voltage VCGW and the black side data line setting voltage VCGK according to the most significant bit D3. All the switches SW0*c*, SW0*d*, SW1*c*, SW1*d*, SW2*c*, and SW2*d* supply the selected voltage to one of the terminals of each of the DAC capacitances CD0 to CD2. The switch 244 supplies the selected voltage to the other terminal of each of the DC capacitances CD0 to CD2 connected through the γ-correction switches 241 to 243 to the data line 6*a*. In this sense, the switches SWck and SWcw and the switches SW0*c*, SW0*d*, SW1*c*, SW1*d*, SW2*c*, and SW2*d*, and the switch 244 serve as the first power supply that supplies power at the first step.

Subsequently, after the active time period of the data line selecting signal SSET finishes, the write signal WRT becomes active. Then, the white side DAC setting voltage VDAW is applied to one of the terminals of each of the selected DAC capacitances CD0 to CD2 corresponding to the bits, whose digits are "1", among the first bit D0 to the bit D3. Further, the white side data line setting voltage VCGW is maintained as the terminal voltage of one of the terminals of each of ones, which are not selected, of the DAC capacitances CD0 to CD2 at a second step.

At that time, the switches SWdk and SWdw select one of the white side DAC setting voltage VDAW and the black side DAC setting voltage VDAK according to the most significant bit D3. The switches SW0*c*, SW0*d*, SW1*c*, SW1*d*, SW2*c*, and SW2*d* supply the selected voltage to one of the terminals of each of the DAC capacitances CD0 to CD2 selected according to the digits of the low order bits D0 to D2. In this sense, the switches SW0*c*, SW0*d*, SW1*c*, SW1*d*, SW2*c*, and SW2*d* and the switches SWdk and SWdw serve as the second power supply that supplies power at the aforementioned second step.

Further, vdaw and vcgw represent the values of the voltages VDAW and VCGW, respectively. Furthermore, cd represents a total sum of the values of the DAC capacitances each having terminals, to one of which the voltage VDAW is applied. Moreover, cd' represents a total sum of the DAC capacitances each having terminals, to one of which the voltage VCGW is applied. Then, the voltage V of the data line 6*a* is given by the following equation (1):

$$V=vcgw+\{cd/(cd+cd'+CS)\}(vdaw-vcgw) \quad (1).$$

The value of (cd+cd'+cs) is a fixed value. Thus, the voltage value V of the data line 6*a* with respect to the gray scale level changes linearly. FIG. 6(A) is a graph illustrating the relationship between the values of the gray scale level and the voltage V applied to the data line 6*a* in the case that the most significant bit D3 is "0". FIG. 6(B) is a table describing the relationship among the value of the gray scale level, a total sum of the selected DAC capacitances, and the value of the voltage of the data line 6*a*.

Incidentally, when the data value of the image data Db1 is "0000", none of the DAC capacitances CD0 to CD2 are selected. Thus, the voltage value V of the data line 6*a* is "vcgw".

(2) In the case that the digit of the most significant bit D3 is "1"

Next, consideration is given to the case that the digit of the most significant bit D3 is "1". In this case, the data value of the image data Db1 ranges from "1000" to "1111" and corresponds to the black side level.

FIG. 7 illustrates an equivalent circuit of the D/A unit in the case that the digit of the most significant bit D3 is "1".

This equivalent circuit operates as follows. First, the data line selecting signal SSET becomes active. Then, the black side data line setting voltage VCGK is supplied to the data line capacitance CS through the switch 244. At that time, the voltage between both terminals of each of the DAC capacitances is the voltage "VCGK".

Subsequently, after the active period of the data line selecting signal SSET is finished, the write signal WRT becomes active. Then, the black side DAC setting voltage VDAK is applied to one of terminals of each of the DAC capacitances CD0 to CD2 selected corresponding to the bits, the digit of each of which is "1", among the first bit D0 to the bit D3 of the image data Db1. The other terminal thereof is connected to the data line 6*a* through a corresponding one of the correction switches 241 to 243. Further, the voltage VCGK is maintained as the terminal voltage of one of the terminals of the unselected ones of the DAC capacitances CD0 to CD2. The other terminal of each of the unselected DAC capacitances is not connected to the data line 6*a*.

Incidentally, "vdak" and "vcgk" represent the values of the voltages VDAk and the voltage VCGK. Further, cd represents a total sum of the values of the DAC capacitances having terminals, to one of which the voltage VDAK is applied. Moreover, cd' represents a total sum of the values of the DAC capacitances having terminals, to one of which the voltage VCGW is applied. Then, the voltage value V of the data line 6*a* is given by the following equation (2):

$$V=vcgk-\{cd/(cd+CS)\}(vcgk-vdak) \quad (2).$$

Incidentally, {cd/(cd+CS)} changes according to the value of the image data. Thus, a change in the voltage value V of the data line 6*a* with respect to the gray scale level is represented by a curved line.

Meanwhile, as described above, the image data converting circuit 500 inverts the low order bits other than the most significant bit of the input image data Din when the digit of the most significant bit D3 is "1", and then outputs data obtained by the inversion as image data D, because the voltages are set so that vcgk>vdak.

FIG. 8(A) is a graph illustrating the relationship between the gray scale level value and the voltage value V of the data line 6*a* when the digit of the most significant bit D3 is "1". FIG. 8(B) is a table illustrating the relationship among the gray scale level value, a total sum of the values of the selected DAC capacitances, and the voltage value of the data line 6*a*. Incidentally, when the data value of the image data Db1 is "1000", none of the DAC capacitances CD0 to CD2 are selected. Thus, the voltage value V of the data line 6*a* is "vcgk".

Further, FIG. 9 is a graph illustrating the overall characteristic of the D/A unit. In this way, the D/A unit determines, according to the most significant bit D3 of the image data Db1 to Dbn, which of the white side and the black side the gray scale levels to be displayed are on. Then, the D/A unit controls the γ-correction switches 241 to 243 according to a result of the determination, and performs γ-correction, if necessary. Thus, an image can be displayed with good gray scale reproducibility and contrast ratio.

<2. Operation of Liquid Crystal Display Device>

First, when the image data D is supplied to the data line driving circuit 200, the input image data D is converted into dot-sequence data by the first latch portion 220. Moreover, this dot-sequence data is converted into line-sequence data by the second latch portion 230. Thus, as illustrated in FIG. 3, the image data Db1 to Dbn, whose data values are changed every horizontal scanning period with the same changing timing, are outputted from the second latch portion 230.

Attention is now paid to jth image data Dbj on a certain horizontal line. FIG. 10 is a timing chart illustrating an operation of the data line driving circuit in the case that the most significant bit of the image data Dbj is "0". In this example, the most significant bit D3 is "0", so that each of output signals of the OR circuits OR0 to OR2 has H level. Consequently, the other terminal of each of the DAC capacitances CD0 to CD2 is connected to the data line 6*a*.

As shown in this figure, when the latch pulse TRS is at H level at a moment T1, image data Dbj outputted from the second latch portion 230 is determined.

Subsequently, when the data line setting signal SSET is at H level at a moment T2, which is slightly behind the moment T1, the data line selecting switch 244 is brought into an on-state. Then, the white side data line setting voltage VCGW is supplied to the data line 6*a*. The data line 6*a* has parasitic capacitance CS and wire resistance. Thus, the voltage V of the data line 6*a* gradually becomes close to the voltage value vcgw, as illustrated in this figure, instead of directly reaching the voltage vcgw.

On the other hand, during the data line setting signal SSET is at H level, the write signal WRT is at L level. Thus, the switches SW0*c*, SW1*c*, and SW2 are put into an on-state. Moreover, the data line setting signal SSET is supplied to one of terminals of each of the DAC capacitances CD0 to CD2.

Furthermore, because the other terminal of each of all the DAC capacitances CD0 to CDn is connected to the data line 6*a*, the white side data line setting voltage VCGW is supplied to both terminals of each of all the DAC capacitances CD0 to CD2 at a moment T3.

Thereafter, when the level of the write signal WRT is changed to H level in a period between a moment T4 and a moment T5, the white side DAC setting voltage VDAW is supplied to the other terminal of each of the DAC capacitances corresponding to the bits, whose digit is "1", among the low order bits D0 to D2. Therefore, a quantity of charge corresponding to the value of the image data Dbj is charged into each of the selected DAC capacitances. Thus, the transfer of charge is performed among the selected DAC capacitances, the unselected DAC capacitances, and the parasitic capacitance CS of the data line 6*a*. In this case, the voltage value V of the data line 6*a* is given by the aforementioned equation (1). Thus, the voltage corresponding to such a value is applied to the data line 6*a* without performing γ-correction on the image data Dbj.

On the other hand, a scanning line signal Y corresponding to a horizontal line is at H level at the moment T2, as illustrated in this figure. After the H level is continued for a predetermined time, the level of this signal becomes the L level. Incidentally, a time period TQ, during which the voltage of the data line 6*a* reaches the L level since the voltage thereof becomes stable, is selected so that the voltage of the data line 6*a* is taken in and a stable voltage can be applied to the pixel electrode 9*a*. Therefore, a voltage corresponding to the value of the image data Dbj is applied to each of the pixel electrodes 9*a*. This enables the gray scale display of the image data.

FIG. 11 shows a timing chart illustrating an operation of the data line driving circuit in the case that the most significant bit of the image data Dbj is "1". In this example, the most significant bit D3 is "1". Therefore, the DAC capacitances corresponding to the bits, the digits of which are "1", among the low order bits D0 to D2, are selected. The other terminal of each of the selected DAC capacitances is connected to the data line 6*a*.

In this case, similarly as in the case that the most significant bit of the image data Dbj is "0", the data line setting signal SSET becomes active after the image data Dbj is specifically determined in synchronization with the latch pulses TRS. Moreover, the data line selecting switch 244 is put into an on-state. Then, the black side data line setting voltage VCGK is supplied to the data line 6*a*. The voltage value V of the data line 6*a* gradually goes close to the voltage value vcgk, as illustrated in the figure.

On the other hand, in a time period during which the data line setting signal SSET is active, the write signal WRT is at the L level. Thus, the switches SW0*c*, SW1*c*, and SW2 are brought into an on-state. The black side data line setting voltage VCGK is supplied to one of terminals of each of the DAC capacitances CD0 to CD2.

In this example, the other terminal of each of the selected DAC capacitances is connected to the data line 6*a*. Thus, the black side data line setting voltage VCGK is supplied to both terminals of each of the selected DAC capacitances at the moment T3.

When the write signal WRT is at the L level in a time period from a moment T4 to a moment T5, the black side DAC setting voltage VDAK is supplied to one of terminals of each of the DAC capacitances CD0 to CD2, the digits of which are "1", among the low order bits D0 to D2.

Therefore, a quantity of charge corresponding to the value of the image data Dbj is charged into each of the selected DAC capacitances. The transfer of the charge is performed among the selected DAC capacitances and the parasitic charge CS of the data line 6*a*. In this case, the voltage V of the data line 6*a* is given by the aforementioned equation (2). Thus, the γ-correction is performed on the image data Dbj. Further, the voltage corresponding to the corrected image data Dbj is applied to the data line 6*a*.

As described above, according to this embodiment, the circuit selects one of options that γ-correction is performed on the image data and that the γ-correction is not performed thereon, according to the value of the most significant bit D3. Moreover, the DAC capacitances CD0 to CD2 are used for both the cases that the γ-correction is performed, and that the γ-correction is not performed thereon. Thus, both the gray scale reproducibility can be improved and the contrast ratio can be enhanced by using a simple configuration.

<3. Example of Configuration of Liquid Crystal Panel>

Next, the entire configuration of the aforementioned liquid crystal panel AA is described hereinbelow with reference to FIGS. 12 and 13. Incidentally, FIG. 12 is a perspective diagram illustrating the entire configuration of the liquid crystal panel AA. FIG. 13 is a sectional diagram taken along plane Z-Z' of FIG. 12.

As illustrated in these figures, the liquid crystal panel AA is constituted by attaching a glass or semiconductor element substrate 101, on which the pixel electrodes 9*a* are formed, to a transparent opposing substrate 102 made of glass by using a seal material 104, in which spacers 103 are mixed, and provided with the common electrode 108 formed thereon, so that the surface, on which the electrodes are formed, of the substrates face each other with the uniform gap maintained, and that liquid crystal 105 serving as an electro-optical material is filled into the gap therebetween. The seal material 104 is formed along the periphery of the opposing substrate 102. However, a part of the seal material 104 is opened for enclosing the liquid crystal 105. Thus, after the liquid crystal 105 is filled into the gap, the opening portion is closed by using a seal member 106.

Then, the aforementioned data line driving circuit 200 is formed on the surface, which faces the opposing substrate 102, of the element substrate 101 and on one outer side of the seal material 104, and drives the data line 6*a* in the Y-direction. Furthermore, a plurality of connecting electrodes 107 are formed on this outer one side of the material 104 and receive various signals from a controller 6.

Further, two scanning line driving circuits 100 are formed on two sides adjoining this outer one side and drive each of the scanning lines 3*a*, which extend in the X-direction, from both sides. Incidentally, in the case that the delay of the scanning signal to be supplied to the scanning lines 112 does not cause trouble, a single scanning line driving circuit 100 may be provided only at one side of the scanning line.

On the other hand, the common electrode 108 on the opposing substrate 102 is electrically connected to the element substrate 101 by an electrically conductive material, which is provided on at least one of four corner portions of attaching part provided between the substrates 101 and 102. Additionally, for instance, first, color filters are arranged in a stripe-like, or mosaic-like or triangular manner, and second, for example, a black matrix, such as a resin black obtained by dispersing metallic materials, such as chromium or nickel, or carbon or titanium materials in a photoresist, and third, a backlight for irradiating light onto the liquid crystal panel 100 are provided on the opposing substrate 102 according to the use of the liquid crystal panel AA. Especially, when the liquid crystal panel 100 is used for color light modulation, the color filters are not formed thereon. Moreover, the black matrix is provided on the opposing substrate 102.

Additionally, alignment layers, on each of which rubbing is performed in a predetermined direction, are provided on the opposed surfaces of the element substrate 101 and the opposing substrate 102, respectively. Moreover, a polarizer (not shown) corresponding to an alignment direction is provided on the rear surface of each of the substrates. Incidentally, when polymer dispersed liquid crystal, which is dispersed as fine particles in polymer and indicated by reference numeral 105 is used, the aforementioned alignment layer, and polarizer are unnecessary. Thus, the efficiency of utilization of light is increased. Therefore, the use of polymer dispersed liquid crystal is advantageous to increase luminance and reduce power consumption of a display device.

Driving IC chips mounted on film by using TAB (Tape Automated Bonding) techniques may be electrically and mechanically connected to each other through anisotropic conductive films provided at predetermined positions of the element substrate 101, instead of providing a part or all of peripheral circuits of the scanning line driving circuit 100 and the data line driving circuit 200 on the element substrate 101. Alternatively, the driving IC chip itself may be electrically and mechanically connected through anisotropic conductive film to a predetermined place on the element substrate 101 by using COG (Chip On Grass) techniques.

<4. Modification of Embodiment>

<4-1: Omission of Image Data Converting Circuit 500>

In the aforementioned embodiment, when the digit of the most significant bit of the input image data Din is "1", the image data D is generated by using the image data converting circuit 500 to invert the low order bits. Meanwhile, the image data converting circuit 500 is practically configured by three exclusive-OR circuits, as described above. Thus, the image data converting circuit 500 may be omitted by providing three exclusive-OR circuits between the latch unit UB1 and the D/A unit UC1 shown in FIG. 4.

<4-2: AC Driving>

The foregoing description of the embodiment has described the case that the white side data line setting voltage VCGW, the white side DAC setting voltage VDAW, the black side data line setting voltage VCGK, and the black side DAC setting voltage VDAK are positive by employing the voltage of the counter electrode as a reference voltage. However, in the practical liquid crystal panel, the AC driving of the liquid crystal of each of the pixels is performed so as to prevent the degradation of the liquid crystal. Thus, regarding the setting voltages, it is necessary to generate positive and negative voltages by employing the voltage of the counter electrode as a reference voltage and to alternately apply the positive and negative voltages to the liquid crystal of each of the pixels. Therefore, the power supply circuit 400 is required to generate the setting voltages by switching between the positive voltage and the negative voltage according to the period of AC driving.

Thus, preferably, the power supply circuit 400 has a positive power supply circuit that generates positive voltages, a negative power supply circuit that generates negative voltages, and a selection circuit that selects one of output voltages of the positive power supply circuit and the negative power supply circuit according to the period of AC driving.

The following schemes for the period of switching the setting voltages are discussed below. A first scheme is to switch the polarity of an applied voltage every vertical scanning period. This is a driving method of inverting the polarity of the applied voltage every vertical scanning period (1 field or 1 frame). A second scheme is to switch the polarity of the applied voltage every horizontal scanning period (which is referred to as a gate line inversion scheme). A third scheme is to invert the polarity of the voltage applied to the liquid crystal at each row (which is referred to as a source line inversion scheme). Another scheme is to invert the polarity of the voltage applied to the liquid crystal at each pixel (which is referred to as a dot inversion scheme).

In the case of these schemes, the polarity of each of the voltages VCGW, VDAW, VCGK, and VDAK should alternately change between the adjacent D/A units. Thus, preferably, the power supply circuit 400 has the negative power supply circuit and the positive power supply circuit and supplies outputs of these power supply circuits to the data line driving circuit 200, <4-3: Relationship between Image Data and White or Black Level>

In the foregoing description of the embodiment, it has been described that when the input image data Din is "1111", this image data corresponds to a black level, and that when the image data D1 is "0000", this image data corresponds to a white level. Conversely, it may be that the data "1111" corresponds to a white level, while the data "0000" corresponds to a black level. Moreover, the embodiment can be similarly applied to the case where the setting of the orientation and polarizing-axis of the liquid crystal molecules are changed (as a normally black mode) so that when an output voltage of the DA converter is low, the permeability is low and that when an output voltage thereof is high, the permeability is high.

<4-4: Switching of γ-correction>

In the aforementioned embodiment, it is determined, according to the most significant bit D3 of the image data D, which of the linear portion and the nonlinear portion of the v-T characteristic the image data D corresponds to. Moreover, when the image data D corresponds to the linear portion, the DA conversion is performed without performing γ-correction. Further, when the image data D corresponds to the non-linear portion, the γ-correction is performed. According to the present invention, it is determined, in accordance with the data value of the image data D, which of the linear portion and the non-linear portion of the v-T characteristic the image data D corresponds to. Thus, the bit serving as a reference for the determination is not limited to the most significant bit D3. On the basis of a predetermined bit, which is preliminarily determined in such a manner as to enable the determination, it may be determined which of the linear portion and the non-linear portion the image data corresponds to.

<5. Examples of Application>

Next, examples of application of the liquid crystal display device described in the foregoing descriptions of the embodiments and the modifications thereof are described hereinbelow.

<5-1: Projector>

First, a projector employing this liquid crystal display device as a light valve is described hereinbelow. FIG. 14 is a plan diagram illustrating the configuration of this projector.

As shown in this figure, in the projector 1100, a lamp unit 1102 that includes a white light source, such as a halogen light, is provided. Projection light irradiated from this lamp unit 1102 is separated into three primaries, namely, R, G, B light rays, by four mirrors 1106 and two dichroic mirrors 1108 in a light guide 1104. The separated light rays are incident upon liquid crystal panels 1110R, 1110B, and 1110G, respectively.

The configuration of each of the liquid crystal panels 1110R, 1110B, and 1110G is the same as that of the aforementioned liquid crystal panel AA. The liquid crystal panels 1110R, 1110B, and 1110G are respectively driven by R, G, and B primary color signals supplied from an image signal processing circuit (not shown). Then, the light rays modulated by these liquid crystal panels are incident upon a dichroic prism 1112 from three directions. This dichroic prism 1112 deflects the R (red) light ray and the B (blue) light ray by 90 degrees. On the other hand, the G (green) light ray travels rectilinearly. Thus, a color image is synthesized from component images displayed in such colors. Then, a color image is projected on the screen through a projection lens 1114.

Regarding images displayed by the liquid crystal panels 1110R, 1110B, and 1110G, it is necessary that the image displayed by the liquid crystal panel 1110G is an image obtained by laterally flipping the image displayed by each of the liquid crystal panels 1110R and 1110B.

Light rays corresponding to R, G, and B primary colors are incident upon the liquid crystal panels 1110R, 1110B, and 1110G, respectively. Thus, there is no need for providing color filters.

<5-2: Mobile Computer>

Next, an example of application of this liquid crystal panel AA to a mobile computer is described hereinbelow. FIG. 15 is a perspective diagram illustrating the configuration of this mobile personal computer. As shown in this figure, the computer 1200 has a main unit portion 1204 provided with a keyboard 1202, and also has a liquid crystal display unit 1206. This liquid crystal display unit 1206 is constituted by adding a backlight to the rear surface of the aforementioned liquid crystal panel 1005.

<5-3: Hand Portable Telephone Set>

Furthermore, an example of application of this liquid crystal panel AA to a hand portable telephone set is described hereinbelow. FIG. 16 is a perspective diagram illustrating this portable telephone set. In this figure, the hand portable telephone set 1300 has a plurality of operating buttons 1302, and also has a refection liquid crystal panel 1005. This reflection liquid crystal panel 1005 has a front light on the front surface thereof.

Incidentally, in addition to the electronic equipment described by referring to FIGS. 14 to 16, a liquid crystal television set, a view finder or monitor direct view video tape recorder, car navigation system, a pager, an electronic notepad, an electric calculator, a word processor, a workstation, a television telephone set, a POS terminal, and various devices each having a touch panel are cited as examples of the electronic equipment. Additionally, needless to say, the present invention can be applied to such various kinds of electronic equipment.

As above described, according to the present invention, it is determined, in accordance with the predetermined bit of image data, whether or not the γ-correction is performed thereon. Further, the DAC capacitances are used for both the cases that the γ-correction is performed thereon, and that the γ-correction is not performed thereon. Thus, in the case of using the electro-optical material exhibiting the V-T characteristic that has the linear portion and the non-linear portion, the gray scale reproducibility and the contrast ratio of the displayed image can be simultaneously enhanced.

What is claimed is:

1. A method for driving an electro-optical panel that includes an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto, the method comprising the steps of:

determining, according to a value of a predetermined bit of image data to be displayed, which of the linear portion and the non-linear portion of the transmittance characteristic the image data corresponds to;

supplying a first voltage to a parasitic capacitance of each of the data lines;

charging a quantity of electric charge, on which γ-correction is performed, into the parasitic capacitance of each of the data lines corresponding to a data value of the image data when it is determined that the image data corresponds to the non-linear portion; and charging a quantity of electric charge, on which γ-correction is not performed, into the parasitic capacitance of each of the data lines corresponding to the data value of the image data when it is determined that the image data corresponds to the linear portion.

2. A method for driving an electro-optical panel that includes an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto, the method comprising the steps of:

determining, according to a value of a predetermined bit of image data to be displayed, which of the linear portion and the non-linear portion of the transmittance characteristic the image data corresponds to, and, when it is determined that the image data corresponds to the non-linear portion, selecting from plural inner capacitances provided correspondingly to each of bits other than the predetermined bit of the image data and weighted according to the bit value thereof, the inner capacitances corresponding to a data value represented by the other bits;

charging a quantity of electric charge corresponding to an image data value into each of the selected inner capacitances; and supplying a voltage to each of the data lines by transferring the charge between a parasitic capacitance thereof and each of the selected inner capacitances, and when it is determined that the image data corresponds to the linear portion, selecting from the plural inner capacitances, the inner capacitances corresponding to the data value represented by the other bits;

charging a quantity of electric charge corresponding to an image data value into each of the selected inner capacitances; and supplying a voltage to each of the data lines by transferring the charge between the parasitic capacitance thereof and each of all of the inner capacitances.

3. A method for driving an electro-optical panel that includes an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto, the method comprising the steps of:

determining, according to a value of a most significant bit of image data to be displayed, which of the linear portion and the non-linear portion of the characteristic the image data corresponds to, and, when it is determined that the image data corresponds to the non-linear portion, selecting from plural inner capacitances provided correspondingly to each of low order bits other than the most significant bit of the image data and weighted according to the bit value thereof, the inner capacitances corresponding to a data value represented by the low order bits;

connecting one of terminals of each of the selected inner capacitances to each of the data lines;

supplying a first data line voltage across both terminals of each of the selected inner capacitances and to each of the data lines; and supplying a first inner capacitance voltage to the other terminal of each of the selected inner capacitances, and when it is determined that the image data corresponds to the linear portion, connecting one of terminals of each of all of the inner capacitances to each of the data lines, and supplying a second data line voltage to the one of terminals thereof and to each of the data lines;

selecting from all of the inner capacitances, the inner capacitances corresponding to a data value represented by the low order bits; and supplying a second inner capacitance voltage to the other terminal of each of the selected inner capacitances.

4. A data line driving circuit for driving data lines of an electro-optical panel that includes an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto, the data line driving circuit comprising:

plural inner capacitances provided correspondingly to each of low order bits other than a most significant bit of the image data and weighted respectively corresponding to bit values thereof;

a switching device provided between each of the inner capacitances and a corresponding one of the data lines and controlled in such a manner as to be on or off according to a digit corresponding to each of bits of the image data;

a first voltage supply that selects one of a first data line voltage and a second data line voltage according to the most significant bit of the image data and supplies the selected voltage to one of terminals of each of all of the inner capacitances and to the other terminal of each of the inner capacitances to be connected thereto through the data lines and the switching device; and a second voltage supply that selects one of a first inner capacitance voltage and a second inner capacitance voltage according to the most significant bit of the image data and for supplying the selected voltage to one of terminals of each of the inner capacitances selected according to each of digits of the low order bits.

5. The data line driving circuit for driving data lines of an electro-optical panel according to claim 4, the switching device determining, according to a digit of the most significant bit of the image data, which of the linear portion and the nonlinear portion of the characteristic of the electro-optical material the image data to be displayed corresponds to, and when the switching device determines that the image data corresponds to the linear portion, the switching device connects one of terminals of each of the inner capacitances to each of the data lines, and, conversely, when the switching device determines that the image data corresponds to the non-linear portion, the switching device selects the inner capacitance corresponding to each of digits of the low order bits and connects one of terminals of the selected inner capacitances to each of the data lines.

6. The data line driving circuit for driving data lines of an electro-optical panel according to claim 5, the switching device including plural OR-circuits, each of the OR-circuits calculating a logical OR of the most significant bit and a corresponding one of the low order bits, and switch circuits, each of the switch circuits being controlled by a corresponding one of the OR circuits in such a manner as to be on or off, and being provided between a corresponding one of the inner capacitances and each of the data lines.

7. A data line driving circuit for driving data lines of an electro-optical panel that includes an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto, the data line driving circuit comprising:

a shift register that sequentially shifts transfer pulses in every horizontal scanning period and sequentially outputs selection signals;

a first latch portion that latches image data according to each of the selection signals and outputs plural dot-sequence image data;

a second latch portion that latches each of dot-sequence image data in every horizontal scanning period and outputs plural line-sequence image data; and a DA conversion portion that DA-converts the line-sequence image data, the DA converting portion including:

plural inner capacitances provided correspondingly to each of low order bits other than a most significant bit of the line-sequence image data and weighted respectively corresponding to bit values thereof;

a switching device provided between each of the inner capacitances and a corresponding one of the data lines and controlled in such a manner as to be on or off according to a digit corresponding to each of bits of the line-sequence image data;

a first voltage supply that selects one of a first data line voltage and a second data line voltage according to the most significant bit of the line-sequence image data and supplies the selected voltage to one of terminals of each of all of the inner capacitances and to the other terminal of each of the inner capacitances to be connected thereto through the data lines and the switching device; and a second voltage supply that selects one of a first inner capacitance voltage and a second inner capacitance voltage according to the most significant bit of the line-sequence image data and supplies the selected voltage to one of terminals of each of the inner capacitances selected according to each of digits of the low order bits.

8. An electro-optical apparatus, comprising:

an electro-optical panel having an electro-optical material, whose transmittance-applied-voltage characteristic has a linear portion and a non-linear portion, a plurality of scanning lines, a plurality of data lines, switching devices provided correspondingly to intersections between the scanning lines and the data lines, and pixel electrodes provided correspondingly thereto;

the data line driving circuit according to claim 4; and a scanning line driving circuit adapted to sequentially generate scanning line signals to select the scanning lines and to output the generated scanning line signals to each of the scanning lines.

9. A device of electronic equipment that includes the electro-optical apparatus according to claim 8 as a display portion.

* * * * *